US010931056B2

(12) United States Patent
Matsui et al.

(10) Patent No.: US 10,931,056 B2
(45) **Date of Patent: *Feb. 23, 2021**

(54) CONNECTOR

(71) Applicants: AutoNetworks Technologies, Ltd., Yokkaichi (JP); Sumitomo Wiring Systems, Ltd., Yokkaichi (JP); Toyota Jidosha Kabushiki Kaisha, Toyota (JP)

(72) Inventors: Hajime Matsui, Yokkaichi (JP); Yasuo Omori, Yokkaichi (JP); Hiroyoshi Maesoba, Yokkaichi (JP); Toshifumi Ichio, Yokkaichi (JP); Kimiyasu Okumura, Yokkaichi (JP); Masaaki Tabata, Yokkaichi (JP); Ryutaro Yamazaki, Toyota (JP); Hiroshi Kobayashi, Okazaki (JP); Motoya Hara, Nisshin (JP)

(73) Assignees: AutoNetworks Technologies, Ltd.; Sumitomo Wiring Systems, Ltd.; Sumitomo Electric Industries, Ltd.; Toyota Jidosha Kabushiki Kaisha

( * ) Notice: Subject to any disclaimer, the term of this patent is extended or adjusted under 35 U.S.C. 154(b) by 0 days.

This patent is subject to a terminal disclaimer.

(21) Appl. No.: 16/660,930

(22) Filed: Oct. 23, 2019

(65) Prior Publication Data

US 2020/0059033 A1 Feb. 20, 2020

Related U.S. Application Data

(63) Continuation of application No. 16/066,074, filed as application No. PCT/JP2017/000157 on Jan. 5, 2017, now Pat. No. 10,490,928.

(30) Foreign Application Priority Data

Jan. 12, 2016 (JP) ..... JP2016-003275

(51) Int. Cl.
*H01R 4/70* (2006.01)
*H01R 13/516* (2006.01)
(Continued)

(52) U.S. Cl.
CPC ..... *H01R 13/516* (2013.01); *H01R 13/4361* (2013.01); *H01R 13/6581* (2013.01); *H01R 13/6592* (2013.01); *H01R 2103/00* (2013.01)

(58) Field of Classification Search
CPC ..... H02G 15/04; H02G 15/00; H02G 15/007; H02G 15/025; H01R 13/516;
(Continued)

(56) References Cited

U.S. PATENT DOCUMENTS 5,516,311 A 5/1996 Maejima
5,795,170 A 8/1998 Okabe
(Continued)

FOREIGN PATENT DOCUMENTS

GB 2308928 A 7/1997
JP 4-46371 4/1992
(Continued)

OTHER PUBLICATIONS

International Search Report dated Mar. 24, 2017.

*Primary Examiner* — Angel R Estrada
(74) *Attorney, Agent, or Firm* — Gerald E. Hespos; Michael J. Porco; Matthew T. Hespos

(57) ABSTRACT

A connector has parts that can be used in common as much as possible in different specifications to reduce cost and to facilitate parts management. In a first specification having a high shielding function, a terminal fitting (20) connected to a shielded electric wire (15) is accommodated in a dielectric (23). The dielectric (23) is surrounded by an outer conductor (40) that is connected to a braided wire (18). The second specification requires no shielding function, and thus the
(Continued)

outer conductor (40) is not used. Rather, a sub-housing (70) having the same shape and size as the outer conductor (40) of the first specification is used. The sub-housing (70) is configured to accommodate and retain the terminal fitting (20) and is locked in a same retained state as in the first specification when accommodated in a common housing (10) used in both specifications.

2 Claims, 19 Drawing Sheets

(51) Int. Cl.

| | |
|---|---|
| ***H01R 13/6592*** | (2011.01) |
| ***H01R 13/436*** | (2006.01) |
| ***H01R 13/6581*** | (2011.01) |
| *H01R 103/00* | (2006.01) |

(58) Field of Classification Search
CPC ..... H01R 13/4361; H01R 13/6581; H01R 13/6592; H01R 2103/00; H01R 13/42; H01R 13/648; H01R 13/52; H01R 24/28; H01R 4/18; H01R 4/00; H01R 13/00; H01R 24/00; H01R 13/514
USPC ..... 174/138 F, 68.1, 74 R, 84 R, 73.1, 84 C, 174/68.3, 72 A, 72 C; 439/877, 878, 879, 439/882, 775, 730, 731, 733.1, 743, 595, 439/865, 866, 869, 874, 867
See application file for complete search history.

(56) References Cited

U.S. PATENT DOCUMENTS

| | | | | |
|---|---|---|---|---|
| 7,559,808 | B2 | 7/2009 | Nishide | |
| 7,601,035 | B2 | 10/2009 | Takahashi | |
| 7,690,954 | B2 | 4/2010 | Watanabe | |
| 7,993,170 | B2 | 8/2011 | Nakata | |
| 8,974,258 | B2 | 3/2015 | Mitose | |
| 10,490,928 | B2 * | 11/2019 | Matsui ..... | H01R 13/6581 |
| 2003/0036316 | A1 | 2/2003 | Fujita et al. | |

FOREIGN PATENT DOCUMENTS

| | | |
|---|---|---|
| JP | 7-22107 | 1/1995 |
| JP | 2000-156261 | 6/2000 |
| JP | 2002-319456 | 10/2002 |
| JP | 2003-36917 | 2/2003 |
| JP | 2017098079 | 6/2017 |

* cited by examiner

CONNECTOR

CROSS REFERENCE TO RELATED APPLICATION

This application is a continuation of U.S. patent application Ser. No. 16/066,074 filed Jun. 26, 2018.

BACKGROUND

Field of the Invention

The present invention relates to a connector.

Description of the Related Art

Japanese Patent Application Publication No. 2002-319456 discloses a connector having a shielding function. This connector incorporates a terminal fitting connected to an end portion of a shielded wire, a dielectric for accommodating the terminal fitting, and an outer conductor connected to the terminal fitting while surrounding the dielectric, and thereby exhibits a high shielding function.

Depending on the grade of the vehicle type, however, a high shielding function may not be required for a connector. In such a case, if every dedicated connector is set for each grade, cost increase and problems in parts management may occur.

The present invention has been accomplished on the basis of the above circumstances, and an object of the present invention is to provide a connector in which parts can be used in common as much as possible in different specifications, thereby making it possible to achieve cost reduction and facilitate parts management.

SUMMARY

A connector of the present invention is capable of selecting either a first specification or a second specification. The first specification includes a terminal fitting attached to a distal end of an electric wire having a shield layer, a dielectric formed of an insulating material and accommodating the terminal fitting in a retained state, an outer conductor formed of a conductive material and connected to the shield layer while surrounding the dielectric, and a housing accommodating the terminal fitting, the dielectric, and the outer conductor in a retained state. The second specification uses at least the housing in common and does not include at least the outer conductor.

In the second specification, a sub housing which accommodates the terminal fitting in a retained state is provided instead of the dielectric, the sub-housing being formed with a lock receiving portion capable of being locked to a lock portion formed in the housing and configured to be incorporated into the housing in a retained state.

A connector according to another aspect of the present invention is capable of selecting either a first specification or a second specification. The first specification includes a terminal fitting attached to a distal end of an electric wire having a shield layer, a dielectric formed of an insulating material and accommodating the terminal fitting in a retained state, an outer conductor formed of a conductive material and connected to the shield layer while surrounding the dielectric, and a housing accommodating the terminal fitting, the dielectric, and the outer conductor in a retained state. The second specification uses at least the housing in common, does not include the outer conductor, and uses the electric wire not having the shield layer.

In the second specification, a sub housing which accommodates the terminal fitting in a retained state is provided instead of the dielectric, the sub-housing being formed with a lock receiving portion capable of being locked to a lock portion formed in the housing and configured to be incorporated into the housing in a retained state.

According to the present invention, when changing from the first specification to the second specification, the outer conductor and the dielectric in the first specification are replaced with the sub-housing. That is, even if such replacement is made, the sub-housing is configured so that it can be incorporated into the housing in a retained state, with the result that free change between the first specification and the second specification becomes possible. At this time, since at least the housing in the first specification can be used as it is also in the second specification, it is possible to switch between both specifications while achieving cost reduction.

The dielectric and the sub-housing each may be divided into half bodies by a dividing plane along a longitudinal direction thereof, and when the terminal fitting is fitted into one of the half bodies from the dividing plane side, a part of the terminal fitting is capable of being locked non-elastically to a lock portion formed in the one half body, and when both half bodies are united, the terminal fitting is accommodated therein in a retained state.

According to such a configuration, by dividing each of the dielectric and the sub-housing along a longitudinal direction thereof, the terminal fitting can be locked non-elastically to the lock portion of the half body. In other words, in a case where each of the dielectric and the sub-housing is not in the divided form but integrally formed, the terminal fitting should be locked inside by elastic locking means such as a lance; in such a form however, there is a need to secure a deflection space of the elastic locking means in the dielectric and the sub-housing, with the result that the dielectric and the sub-housing both become large in size due to such a space. In this respect, with the above configuration of the present invention, the dielectric and the sub-housing can be miniaturized so that they can each be incorporated into a small common housing. The electric wire may be a twisted wire formed by twisting two core wires together. The core wires are covered with respective insulating inner covers. The first specification uses a shielded electric wire provided with a braided wire and an insulating outer cover. The braided wire serves as the shield layer and collectively surrounds the insulating inner covers, and the insulating outer cover surrounds the braided wire. The braided wire is selectively useable in the electric wire in the second specification.

In the first specification, the braided wire in a state of being exposed by peeling off of an end portion of the outer cover and folded back onto the outer cover is swaged by a swaging piece formed in the outer conductor.

In the second specification, a swaging ring is provided which indirectly swages the outer cover with the folded-back braided wire being interposed therebetween, or directly swages the outer cover without the braided wire being interposed therebetween.

According to the above configuration, in the first specification, the swaging piece of the outer conductor is swaged onto the folded-back braided wire to be electrically connected, and the outer cover is swaged to the inner cover via the braided wire, with the result that it is possible to avoid a situation where the outer cover is displaced with respect to the inner cover. Also in the second specification, since the outer cover is swaged to the inner cover by the swaging ring via or not via the braided wire, it is possible to avoid the situation where the outer cover is displaced with respect to the inner cover.

DETAILED DESCRIPTION

Figure 1:
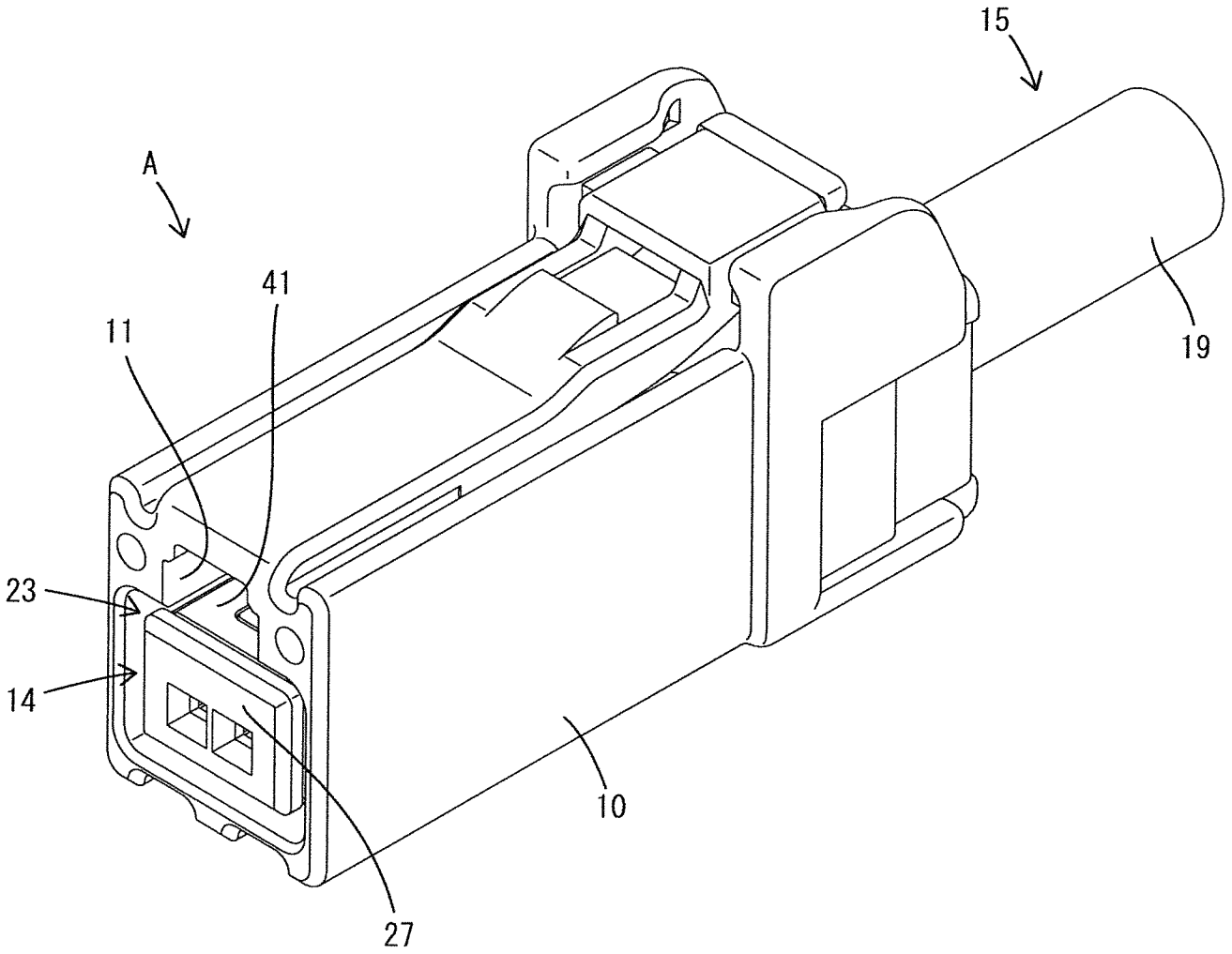
FIG. 1 is a perspective view showing the whole of a connector in a first specification.

Next, an embodiment embodying the connector of the present invention will be described with reference to the drawings. The connector of the present embodiment is used for an automatic driving control system of a car, for example, and is a connector realizing miniaturization. In the connector of the present embodiment, it is possible to select either a first specification having the shielding function or a second specification not having the shielding function which will be described below.

First Specification

The first specification is shown in FIGS. 1 to 13. A connector A in the first specification is constructed including a housing 10 and a terminal module 14 (see FIGS. 2 to 5) to be inserted into the housing 10. The terminal module 14 is attached to an end portion of a shielded electric wire 15 and includes a pair of terminal fittings 20, a dielectric 23, and an outer conductor 40.

Figure 2:
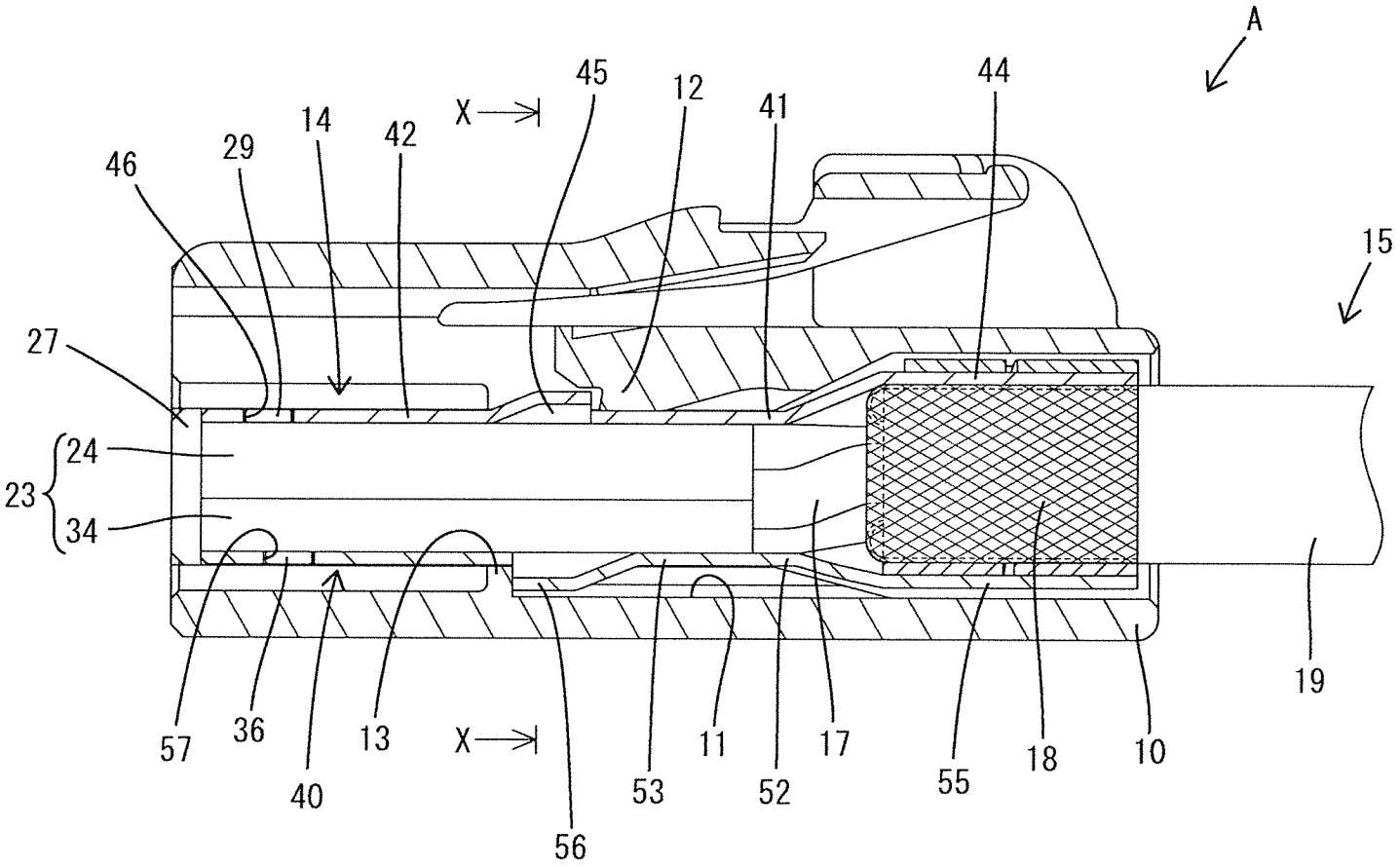
FIG. 2 is a side sectional view thereof.
Figure 3:
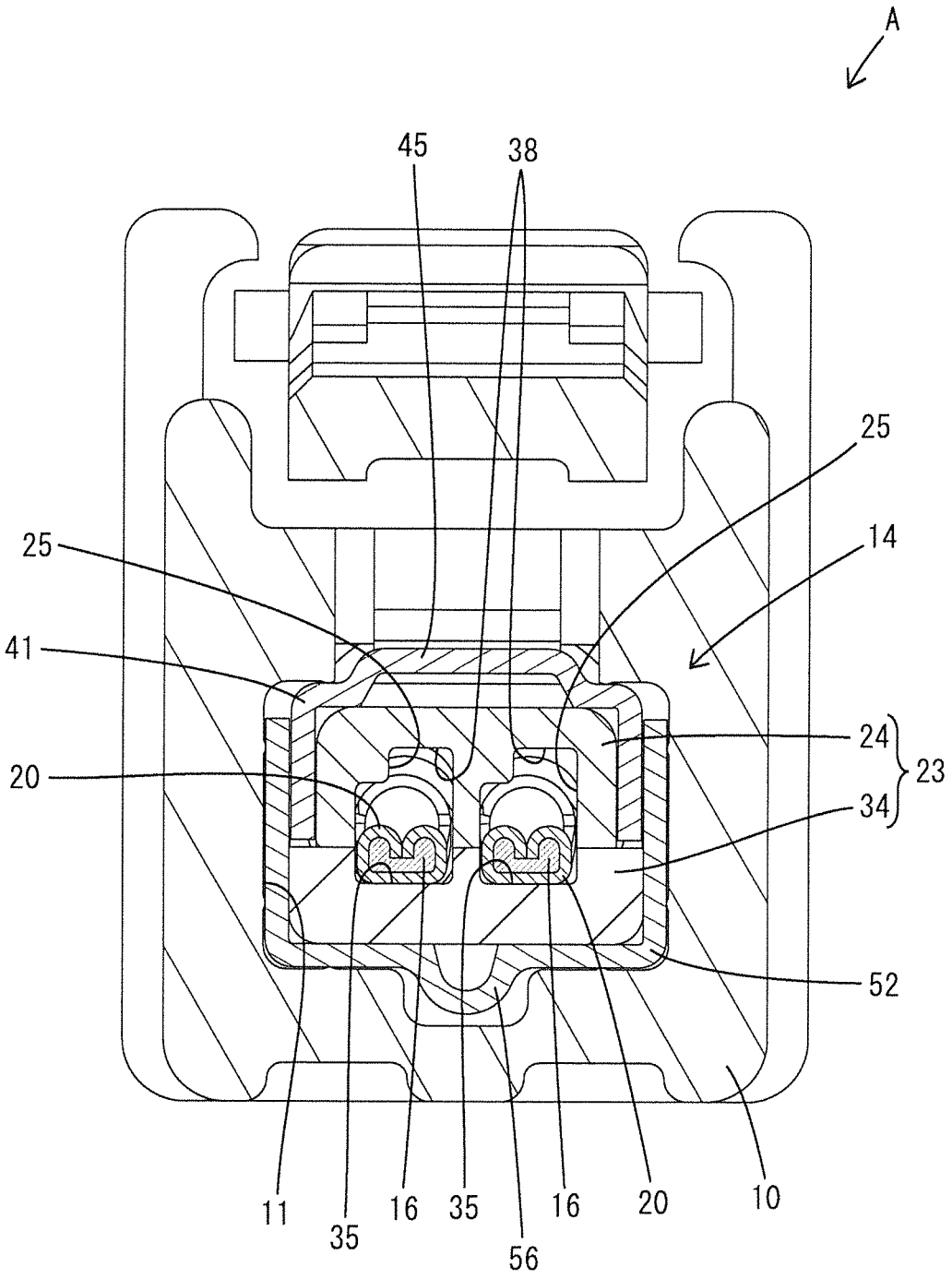
FIG. 3 is a front sectional view thereof.
Figure 4:
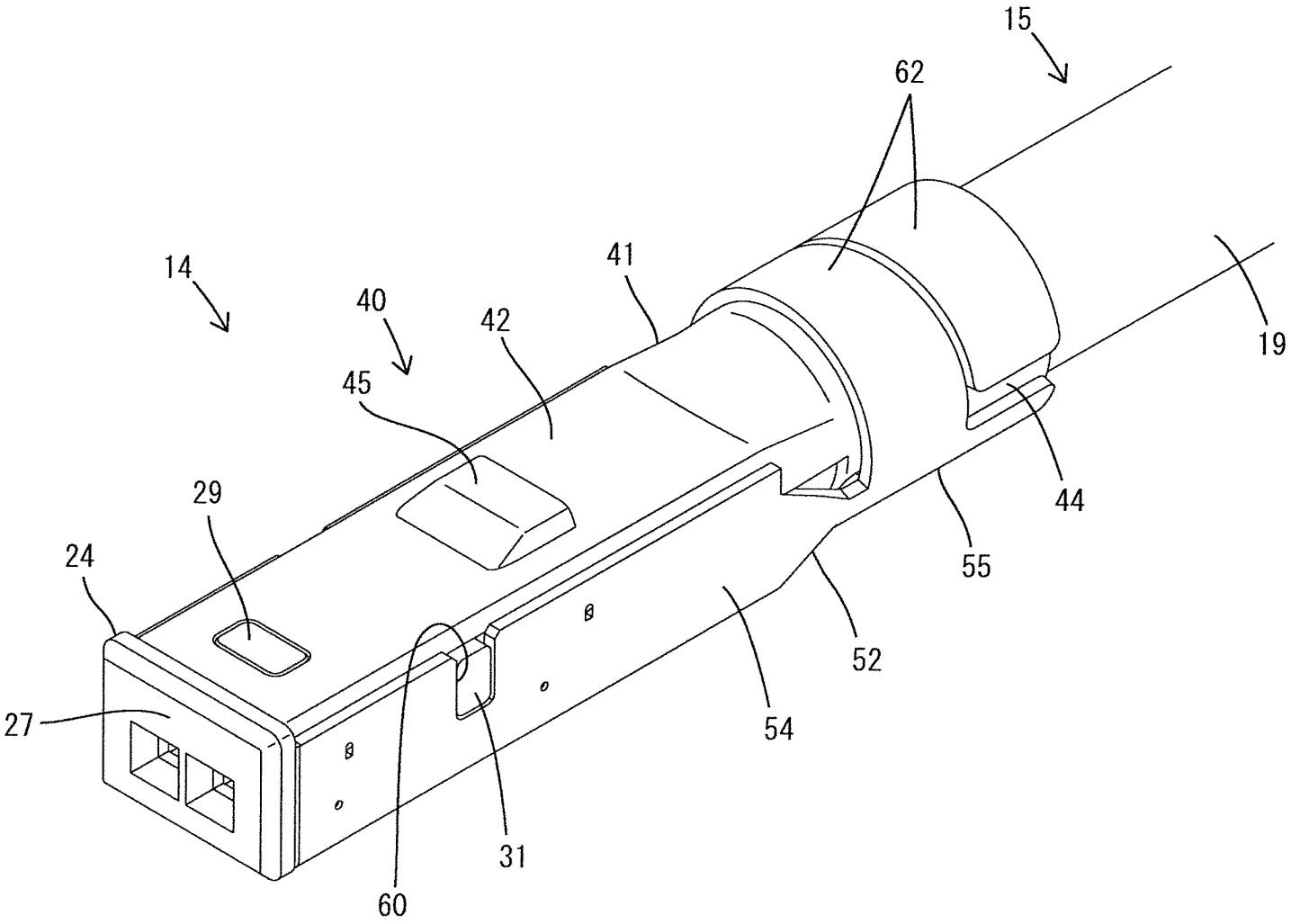
FIG. 4 is a perspective view of a terminal module viewed from the upper surface side.
Figure 9:
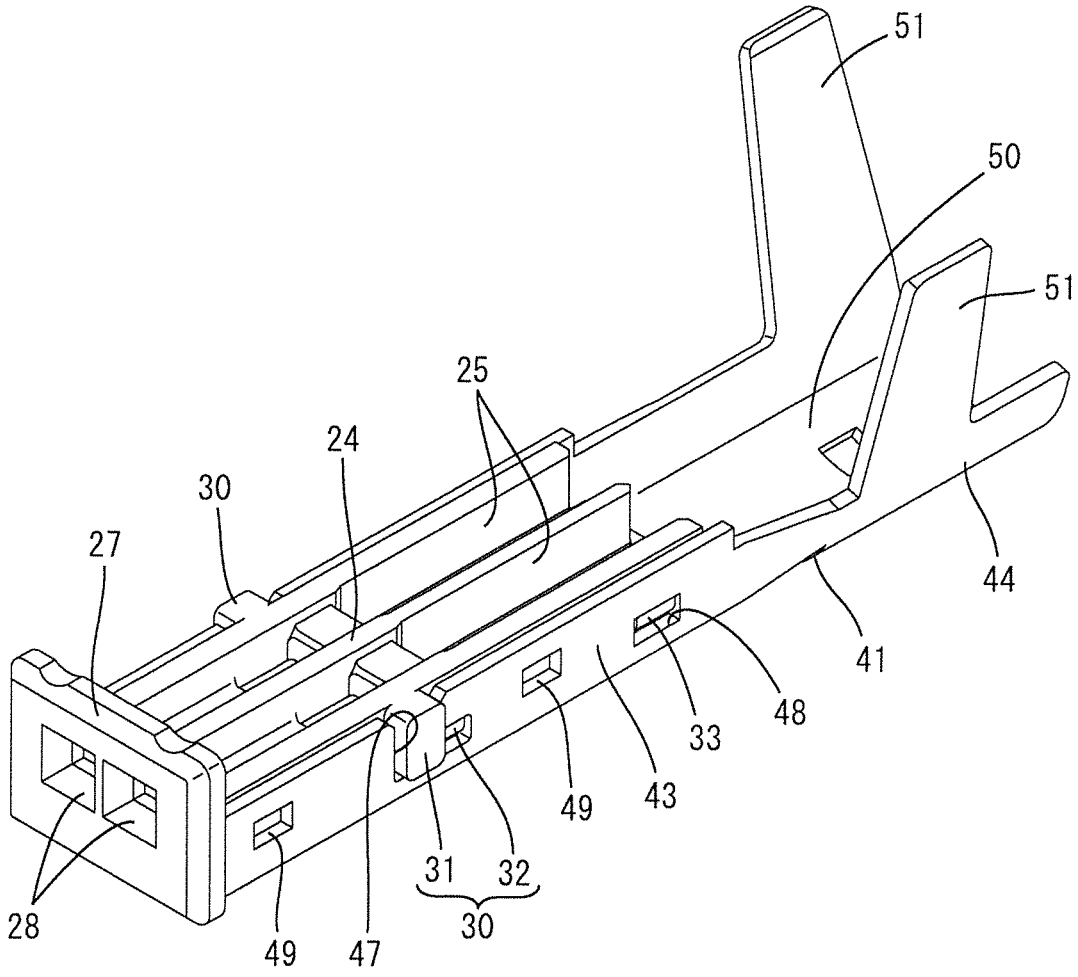
FIG. 9 is a perspective view showing a state reversed from the state of FIG. 8.
Figure 10:
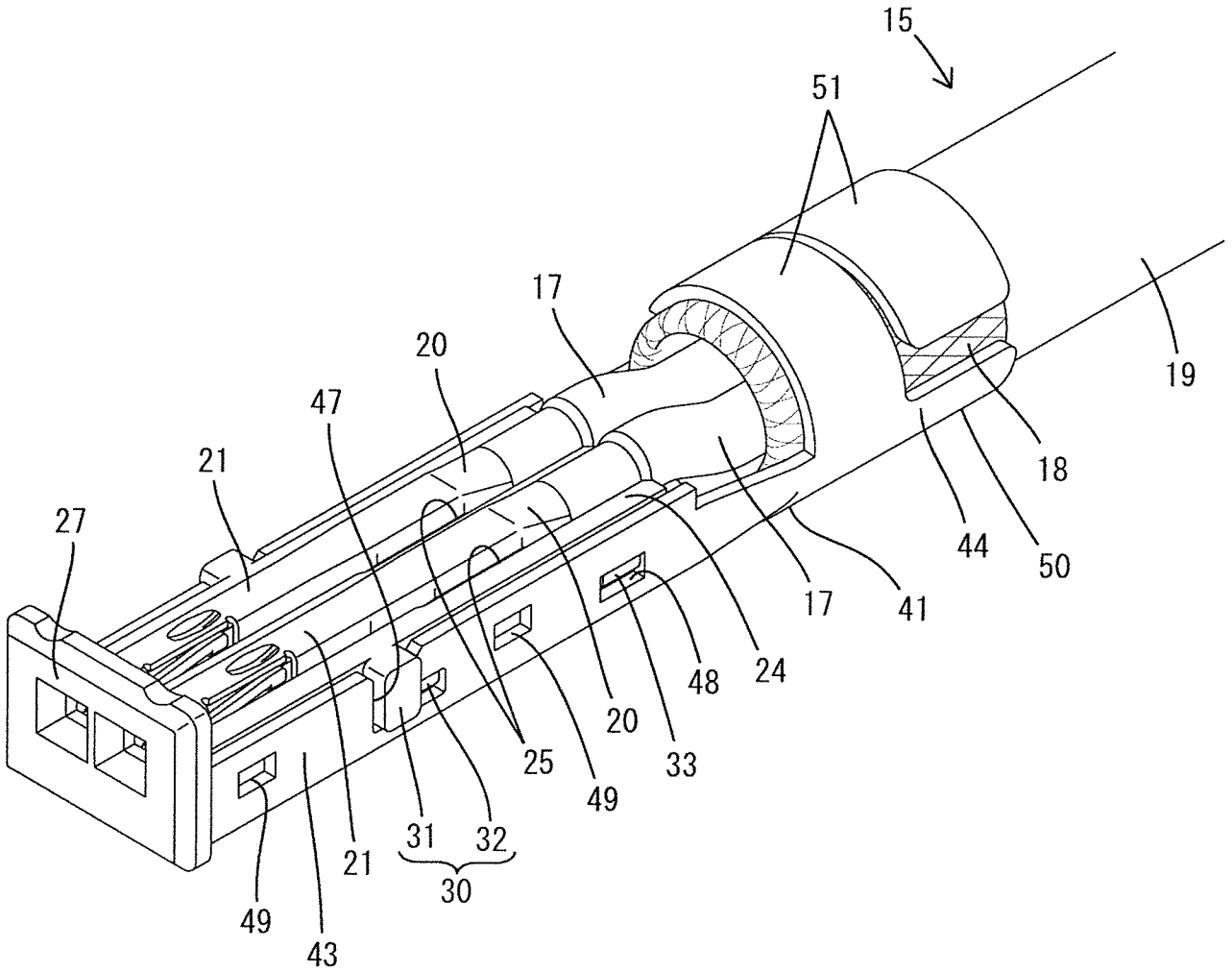
FIG. 10 is a perspective view showing a state in which a terminal fitting is accommodated in a component in which the upper case and the upper shell are assembled.
Figure 11:
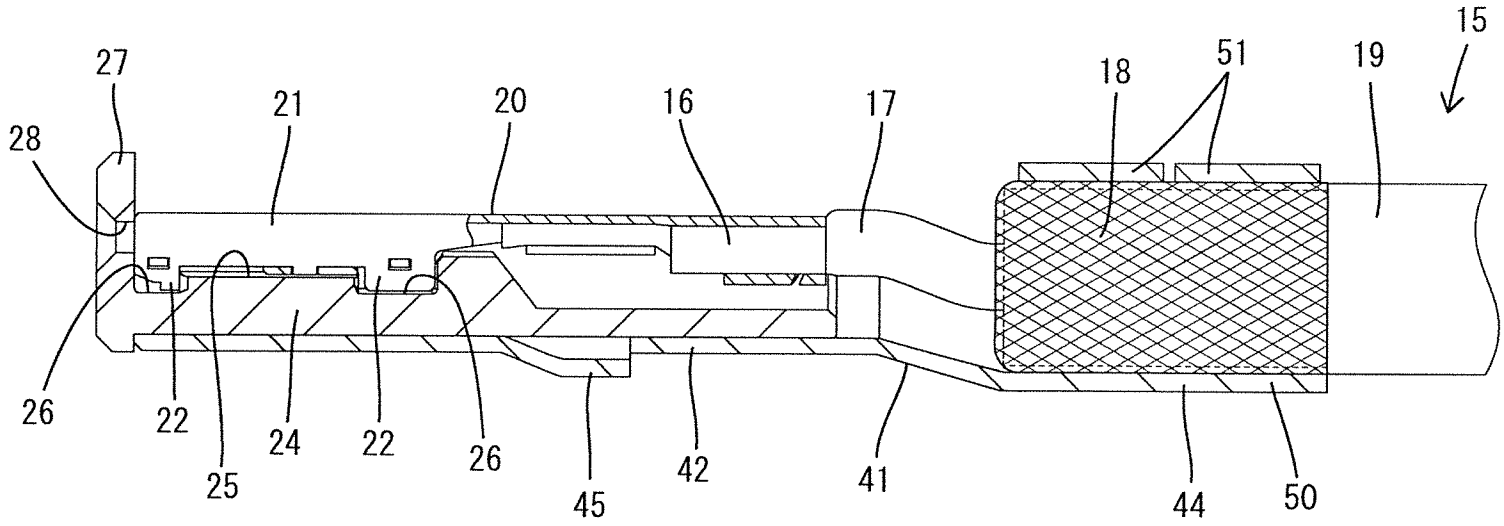
FIG. 11 is a cross-sectional view showing a state in which the electric wire is accommodated in the upper case.

In the following description, as for a front-rear direction, the lower left side in FIGS. 1, 4 to 10, 12, and 13 and the left side in FIGS. 2, 3, and 11 are defined as a front. As for an up-down direction, the directions shown in FIGS. 1 to 13 are defined as an upper side and a lower side as they are. As for a right-left direction, the directions shown in FIG. 3 are defined as a right side and a left side as they are.

(Housing 10)

The housing 10 is formed of a synthetic resin. As shown in FIGS. 2 and 3, an accommodating space 11 for accommodating the terminal module 14 is formed inside the housing 10. The accommodating space 11 has a form penetrating the housing 10 in the front-rear direction. In the accommodating space 11, an elastic retaining piece 12 is formed so as to extend forward in a cantilever manner along the upper surface of the accommodating space 11. The elastic retaining piece 12 is elastically deformable in the up-down direction (a direction intersecting with an insertion direction of the terminal module 14 with respect to the accommodating space 11). In the accommodating space 11, a stopper 13 protrudeS upward from the lower surface of the accommodating space 11.

(Electric Wire 15)

Figure 6:
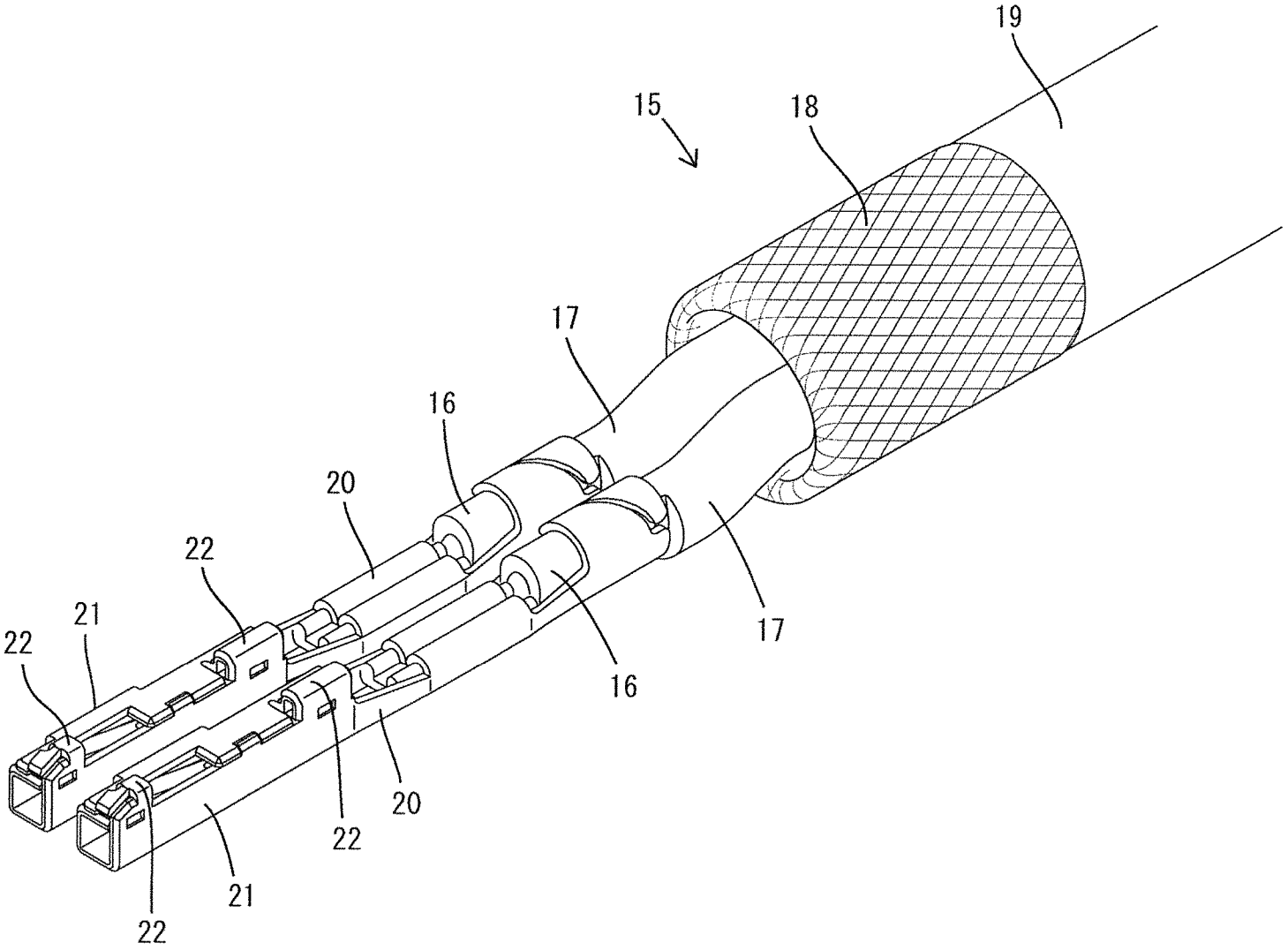
FIG. 6 is a perspective view showing a state in which a terminal fitting is connected to an electric wire.

As shown in FIGS. 6 and 11, the electric wire 15 in the first specification is a shielded electric wire. The electric wire 15 includes two core wires 16 constituted of covered electric wires, insulating inner covers 17 formed of a synthetic resin and surrounding the two core wires 16, a braided wire 18 (a shield layer described in the claims) collectively surrounding the two core wires 16 surrounded by the insulating inner covers 17, and an outer cover 19 formed of a synthetic resin and surrounding the braided wire. In an inner space of the outer cover 19, the two core wires 16 are twisted together to form a twisted pair wire. In a front end portion of the electric wire 15, the two core wires 16 are untwisted and exposed from a front end of the outer cover 19 so as to be arranged in substantially parallel to each other. Similarly, in the front end portion of the electric wire 15, the braided wire 18 exposed by removing the outer cover 19 is folded rearward and covered onto an outer circumference of a front end portion of the outer cover 19.

(Terminal Fitting 20)

As shown in FIG. 6, a rear end portion of the terminal fitting 20 elongated in the front-rear direction is fasten to each end portion of the core wires 16 so as to be conductible. A front end region of the terminal fitting 20 serves as a terminal body portion 21 having a rectangular tubular shape, and the terminal body portion is formed with a pair of positioning protrusions 22 projecting up at front and rear end portions thereof (Dielectric 23)

The dielectric 23 is formed of a synthetic resin and generally has a shape elongated in the front-rear direction. The dielectric 23 is constructed by uniting an upper case 24 (one of half bodies described in the claims) shown in FIG. 7 and a lower case 34 (the other half body described in the claims) shown in FIG. 12. The direction in which the upper case 24 and the lower case 34 are united is the up-down direction (that is, a direction intersecting with the front-rear direction in which the terminal fittings 20 and the end portion of the electric wire 15 are lined).

The upper case 24 is formed with right and left accommodating recesses 25 in a form such that the lower surface of the upper case 24 is recessed. The accommodating recess 25 is elongated in the front-rear direction and formed over the entire length of the upper case 24. As shown in FIGS. 9 and 11, the accommodating recess 25 includes front and rear positioning recesses 26 in a form such that the upper surface of the accommodating recess 25 is recessed. A substantially upper half of the terminal fitting 20 is accommodated in the accommodating recess 25.

A front wall portion 27 protrudes down at a front end portion of the upper case 24. The front wall portion 27 is formed with right and left tab insertion openings 28. The tab insertion openings 28 are each disposed to face a front end of the terminal body portion 21 of the terminal fitting 20 fitted in the accommodating recess 25. A tab (not shown) of a male terminal of a mating connector (not shown) is configured to penetrate the tab insertion opening 28 and to be inserted into the terminal body portion 21 of the terminal fitting 20 when the connectors are fitted together.

Figure 7:
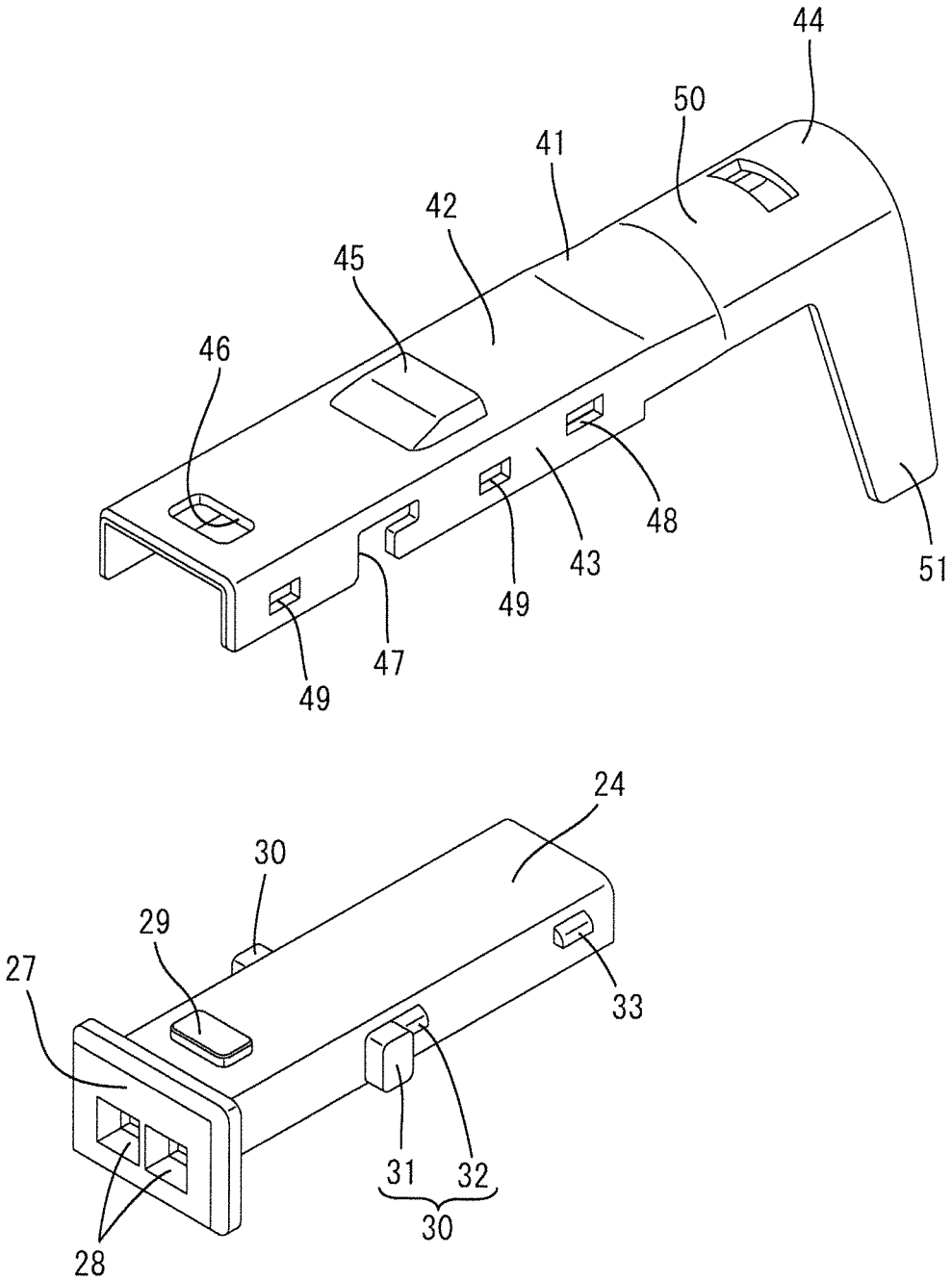
FIG. 7 is an exploded perspective view showing an upper case and an upper shell.

As shown in FIG. 7, an upper surface protrusion 29 is formed on an upper surface of the upper case 24. The upper surface protrusion 29 is disposed at the front end portion of the upper case 24. The upper case 24 has right and left outer surfaces formed with a pair of right and left symmetrical first side surface protrusions 30. The first side surface protrusions 30 are disposed at substantially a central portion in the front-rear direction of the upper case 24. The first side surface protrusions 30 are each constituted of a main projection 31 and a sub projection 32. The sub-protrusion 32 has a smaller protruding dimension than that of the main protrusion 31 and has a smaller dimension in the up-down direction than that of the main protrusion 31. The sub-protrusion 32 protrudes rearward from a rear surface of an upper end portion of the main protrusion 31. The right and left outer surfaces of the upper case 24 are formed with right and left symmetrical second side surface protrusions 33. The second side surface protrusions 33 are disposed at a rear end portion of the upper case 24 (a position behind the first side surface protrusions 30).

Figure 12:
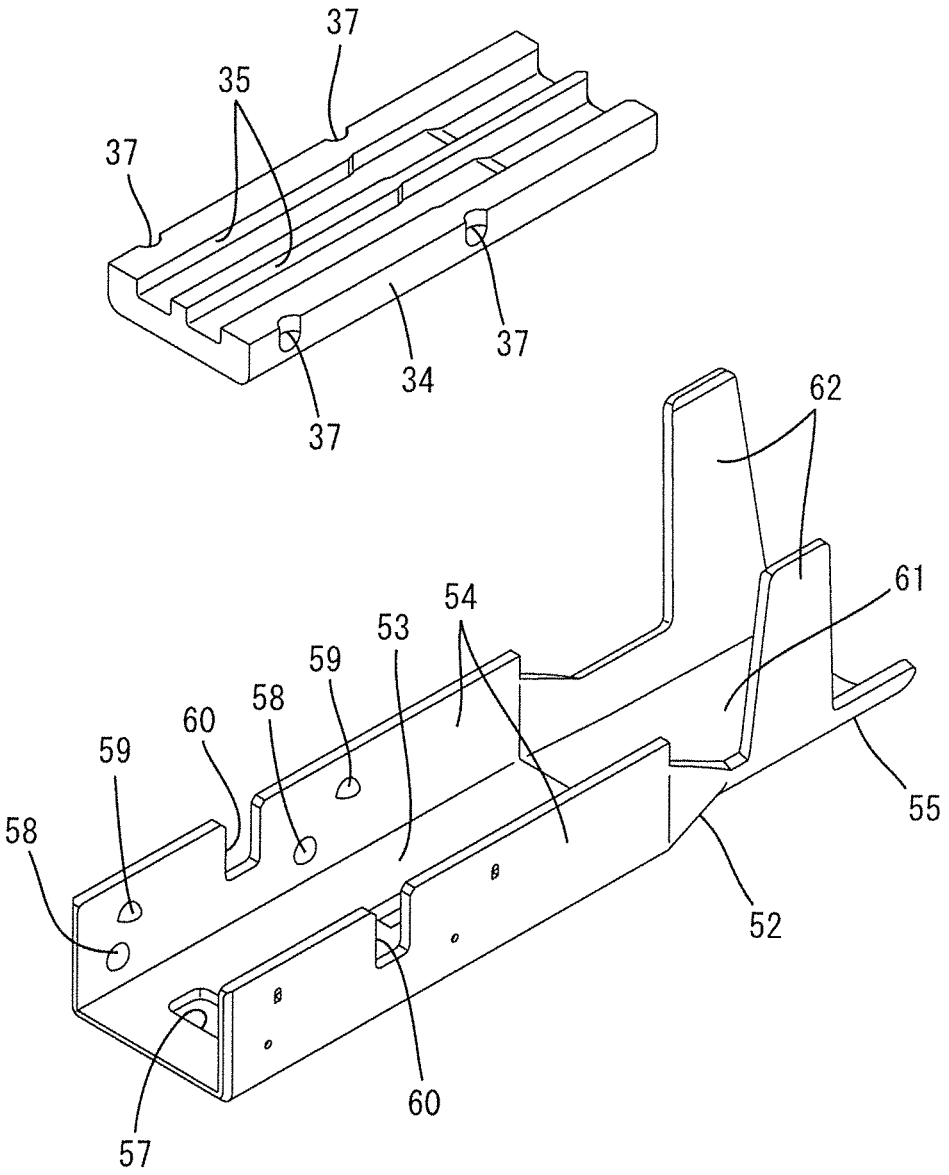
FIG. 12 is a perspective view showing a lower case and a lower shell.

As shown in FIG. 12, the lower case 34 is formed with right and left accommodating grooves 35 in a form such that the upper surface of the lower case 34 is recessed. The accommodating groove 35 is elongated in the front-rear direction and formed over the entire length of the lower case 34. As shown in FIG. 3, a substantially lower half portion of the terminal fitting 20 is accommodated in the accommodating groove 35. The terminal fitting 20 accommodated in the accommodating groove 35 is sandwiched by inner surfaces of the accommodating groove 35 and thereby positioned in a state where relative displacement with respect to the lower case 34 in the right-left direction is restricted.

Figure 5:
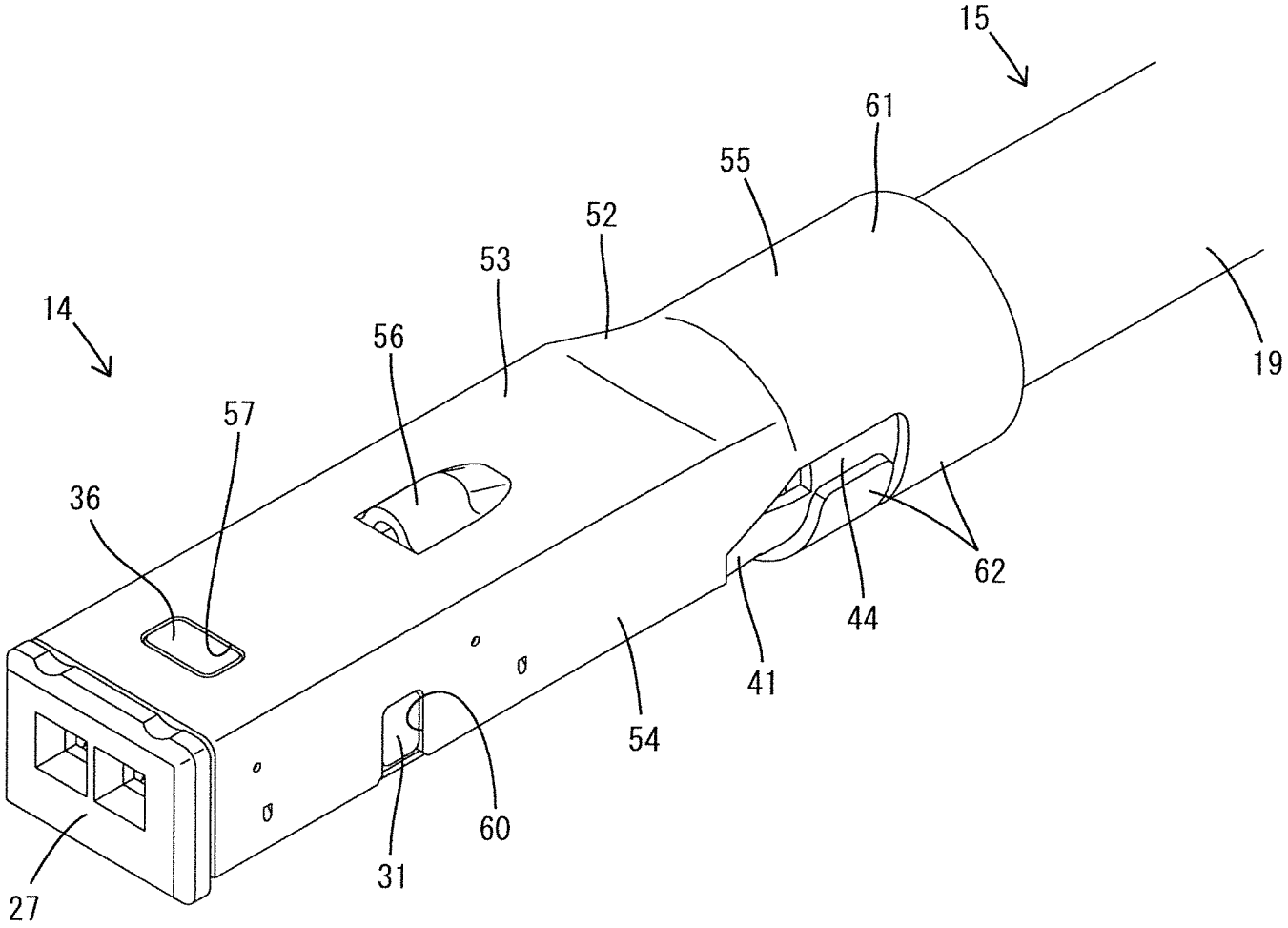
FIG. 5 is a perspective view showing a state in which the terminal module is reversed from the state of FIG. 4.

As shown in FIG. 5, a lower surface protrusion 36 is formed on a lower surface of the lower case 34. The lower surface protrusion 36 is disposed at a front end portion of the lower case 34. The lower case 34 has right and left outer surfaces formed with two pairs of right and left symmetrical side surface recesses 37. The two pairs of side surface recesses 37 are disposed at the front end portion of the lower case 34 and at substantially a central portion in the front-rear direction of the lower case 34.

The upper case 24 and the lower case 34 are united such that the accommodating recesses 25 and the accommodating grooves 35 vertically face each other, thereby constituting the dielectric 23. In a state where the cases 24 and 34 are united, right and left terminal accommodating chambers 38 constituted of the accommodating recesses 25 and the accommodating grooves 35 is formed inside the dielectric 23. The upper case 24 and the lower case 34 do not have portions directly locked to and fitted with each other. Thus, the dielectric alone does not have a function of holding the cases 24 and 34 in a united state, but the cases 24 and 34 are held in the united state via an outer conductor 40, which will be described later.

(Outer Conductor 40)

The outer conductor 40 is formed into a substantially rectangular tubular shape long in the front-rear direction, for example by bending a metal plate material having a predetermined shape and has a shielding function. The outer conductor is formed by uniting the upper shell 41 shown in FIG. 7 and the lower shell 52 shown in FIG. 12. Similarly to the dielectric 23, the direction in which the upper shell 41 and the lower shell 52 are united is the up-down direction (that is, a direction intersecting with the front-rear direction in which the terminal fittings 20 and the end portion of the electric wire 15 are lined).

The upper shell 41 is constructed including a top plate portion 42, right and left symmetrical inner surface plate portions 43 extending down from right and left side edges of the top plate portion 42, and an upper side crimping portion 44. The top plate portion 42 is formed with a retaining protrusion 45 protruding up (outward). The retaining protrusion 45 is disposed at substantially a central portion in the front-rear direction of the top plate portion 42. A front end portion of the top plate portion 42 is formed with a top locking portion 46 penetrating in a plate thickness direction (up-down direction) of the top plate portion 42.

The right and left inner surface plate portions 43 are formed with right and left symmetrical first side surface locking portions 47. Each of the first side surface locking portions 47 is disposed at a position slightly forward of a substantially central portion in the front-rear direction of the inner surface plate portion 43. The first side surface locking portion 47 penetrates the inner surface plate portion 43 in the right-left direction and is open at a lower end edge of the inner surface plate portion 43. The opening shape of the first side surface locking portion 47 allows the entire first side surface protrusion 30 to be fitted thereto. The right and left inner surface plate portions 43 are formed with right and left symmetrical second side surface locking portions 48. Each of the second side surface locking portions 48 is disposed at a rear end portion of the inner surface plate portion 43. The second side surface locking portion 48 penetrates the inner surface plate portion 43 in the plate thickness direction (right-left direction). The opening shape of the second side surface locking portion 48 is a shape that allows the entire second side surface protrusion 33 to be fitted thereto.

The right and left inner surface plate portions 43 are formed with two pairs of right and left symmetrical fitting holes 49. The two pairs of fitting holes 49 are arranged at front end portions of the inner surface plate portions 43 and at positions between the first side surface locking portions 47 and the second side surface locking portions 48 in the inner surface plate portions 43. Each of the fitting holes 49 penetrates the inner surface plate portion 43 in the plate thickness direction (right-left direction).

The upper side crimping portion 44 extends rearward from a rear end of the top plate portion 42. The upper side crimping portion 44 has an open barrel shape including an upper side base plate portion 50 continued to the top plate portion 42 and two upper side swaging pieces 51 extending down from right and left side edges of the upper side base plate portion 50. The upper side swaging pieces 51 are arranged at longitudinally displaced positions from each other. The upper side crimping portion 44 is fastened to an outer circumference of the braided wire 18. The braided wire 18 is sandwiched between an outer circumference of the outer cover 19 of the shielded electric wire and the upper side crimping portion 44 over the entire circumference thereof, and is connected to the upper shell 41 (outer conductor 40) so as to be conductible.

The lower shell 52 is constructed including a bottom plate portion 53, right and left symmetrical outer surface plate portions 54 extending up from right and left side edges of the bottom plate portion 53, and a lower side crimping portion 55. The bottom plate portion 53 is formed with a front stop portion 56 protruding down (outward). The front stop portion 56 is disposed at substantially a central portion in the front-rear direction of the bottom plate portion 53 (at substantially the same position as the retaining projection 45). A front end portion of the bottom plate portion 53 is formed with a bottom locking portion 57 penetrating in the plate thickness direction (up-down direction) of the bottom plate portion 53.

The right and left outer surface plate portions 54 are formed with two pairs of right and left symmetrical side surface protrusions 58. The side surface protrusions 58 are disposed at front end portions of the outer surface plate portions 54 and central portions in the front-rear direction of the outer surface plate portions 54. The side surface protrusions 58 each have a form such that the outer surface plate portion 54 is knocked inward. Similarly, the right and left outer surface plate portions 54 are formed with two pairs of right and left symmetrical fitting protrusions 59. The fitting protrusions 59 are disposed at the front end portions of the outer surface plate portions 54 and the central portions in the front-rear direction of the outer surface plate portions 54. The side surface protrusions 58 are disposed at positions closer to the bottom plate portion than the fitting protrusions 59. Similarly to the side surface protrusion 58, the fitting protrusions 59 each have a form such that the outer surface plate portion 54 is knocked inward.

The right and left outer surface plate portions 54 are formed with right and left symmetrical positioning cut-outs 60. Each of the positioning cut-outs 60 penetrates the outer surface plate portion 54 in the plate thickness direction (right-left direction) and is open at an upper end edge of the outer surface plate portion 54. The positioning cut-out 60 is configured to be fitted with the main protrusion 31 only of the first side surface protrusion 30 of the upper case 24.

The lower side crimping portion 55 extends rearward from a rear end of the bottom plate portion 53. The lower side crimping portion 55 has an open barrel shape provided with a lower side base plate portion 61 continued to the bottom plate portion 53 and two lower side swaging pieces 62 extending upward from right and left side edges of the lower side base plate portion 61. The lower side swaging pieces 62 are arranged at longitudinally displaced positions from each other. The lower side crimping portion 55 is fastened to an outer circumference of the upper side crimping portion 44. In the fastened state, the lower side base plate portion 61 is in close contact with an outer circumferential surface of the upper side swaging pieces 51, and the lower side swaging pieces 62 are in close contact with an outer circumferential surface of the upper side base plate portion 50.

(Assembling Process of First Specification)

Figure 8:
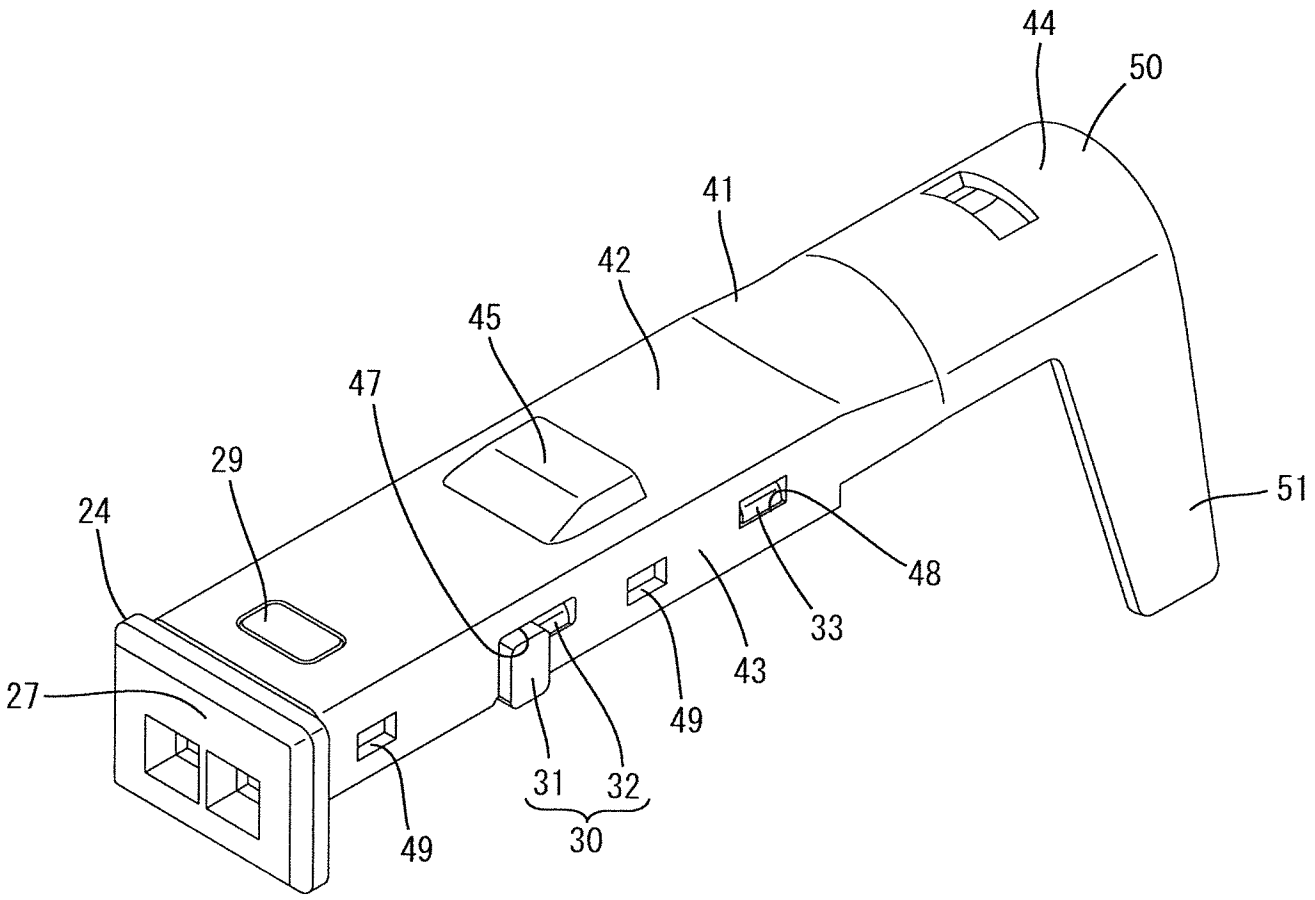
FIG. 8 is a perspective view of a state in which the upper case and the upper shell are assembled as viewed from the upper surface side.

The connector A in the first specification is assembled in the following procedure. First, as shown in FIGS. 8 and 9, the upper case 24 is assembled in the upper shell 41. In the assembled state, the upper case 24 is sandwiched between the right and left inner surface plate portions 43 of the upper shell 41, and the upper surface of the upper case 24 comes into close contact with or faces close to a lower surface of the top plate portion 42 of the upper shell 41. The upper surface protrusion 29 of the upper case 24 is fitted to the top locking portion 46 of the upper shell 41, and the first side surface protrusions30 and the second side surface protrusion 33 of the upper case 24 are fitted to the first side surface locking portion 47 and the second side surface locking portion 48 of the upper shell 41, respectively. Thus, the upper case 24 and the upper shell 41 become a positioned state in which relative displacement in the front-rear direction, the right-left direction, and the up-down direction are restricted, and held in the assembled state.

As shown in FIG. 9, the upper case 24 and the upper shell 41 assembled to be integrated are turned upside down, and as shown in FIG. 10, the terminal fittings 20 are accommodated in the accommodating recesses 25 of the upper case 24. At this time, the terminal fitting 20 is not displaced in the length direction of the electric wire 15 from the rear side of the upper case 24, but is put down into the accommodating recess 25 from above the upper case 24. The direction of displacement of the terminal fitting 20 at this time is a direction intersecting with the front-rear direction in which the terminal fittings 20 and the end of the electric wire 15 are lined.

As shown in FIGS. 3 and 10, each of the terminal fittings 20 accommodated in the accommodating recess 25 is sandwiched by the inner surfaces of the accommodating recess 25 and thereby positioned in a state where the relative displacement with respect to the upper case 24 in the right-left direction is restricted. As shown in FIG. 11, by fitting the positioning protrusions 22 into the positioning recesses 26, the terminal fitting 20 accommodated in the accommodating recess 25 is positioned in a state where the relative displacement in the front-rear direction with respect to the upper case 24 is restricted. Thus, the terminal fittings 20 are temporarily held with respect to the upper case 24 and the upper shell 41.

After the terminal fittings 20 are accommodated in the upper case 24, the upper side crimping portion 44 is crimped onto the outer circumference of the braided wire 18. At this time, the upper side swaging pieces 51 are swaged so as to wind around the outer circumference of the braided wire 18. As a result, the upper shell 41 is integrated with the outer cover 19 of the electric wire 15, so that the upper case 24 assembled to the upper shell 41 and the terminal fittings 20 accommodated in a positioned state in the upper case 24 are restricted from being displaced in the front-rear direction, the right-left direction, and the up-down direction with respect to the outer cover 19 of the shielded electric wire 15.

Figure 13:
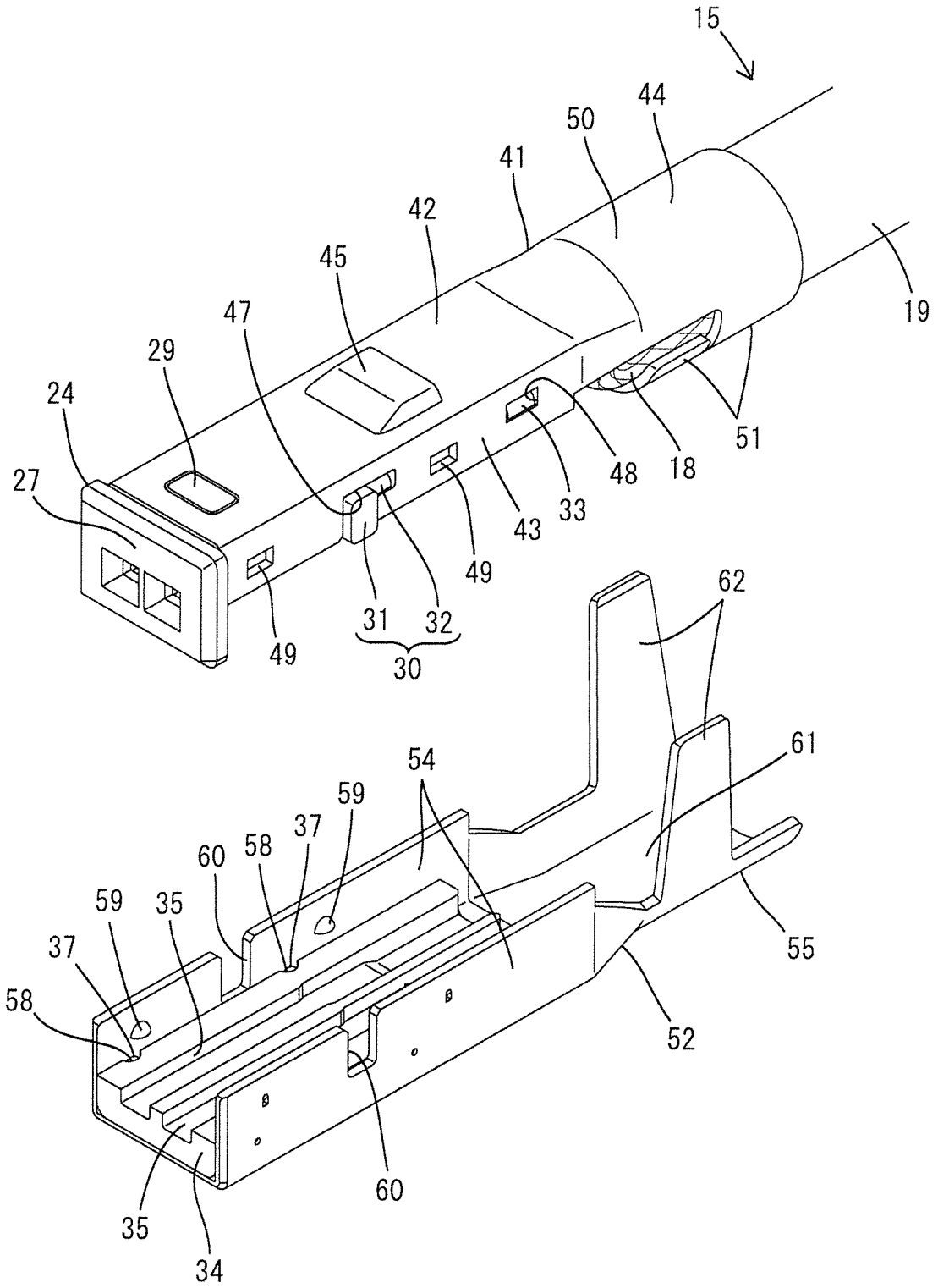
FIG. 13 is a perspective view showing a state reversed from a state in which the upper case and the upper shell are united and the terminal fitting is mounted, and a state in which the lower case and the lower shell are united.

At the same time as or before or after the process of assembling the upper case 24 and the upper shell 41 together as described above, a process of assembling the lower case 34 into the lower shell 52 is carried out, as shown in FIG. 13. In the assembled state, the lower case 34 is sandwiched between the right and left outer surface plate portions 54 of the lower shell 52, and the lower surface of the lower case 34 comes into close contact with or faces close to an upper surface of the bottom plate portion 53 of the lower shell 52. The lower surface protrusion 36 of the lower case 34 is fitted to the bottom locking portion 57 of the lower shell 52, and the side surface recesses 37 of the lower case 34 are fitted with the side surface protrusions 58 of the lower shell 52. Thus, the lower case 34 and the lower shell 52 become positioned state in which relative displacement in the front-rear direction, the right-left direction, and the up-down direction are restricted, and held in the assembled state.

The lower case 34 and the lower shell 52 assembled to be integrated are united with the upper case 24 and the upper shell 41 in a state of being turned upside down, so as to sandwich the terminal fitting 20 therebetween from above. When they are united, the accommodating grooves 35 of the lower case 34 are fitted to the terminal fittings 20, the dielectric body 23 is constituted by the upper case 24 and the lower case 34, and at the same time, the outer conductor 40 is constituted by the upper shell 41 and the lower shell 52. In the dielectric 23, the right and left two terminal accommodating chambers 38 are constituted by the accommodating recesses 25 and the accommodating grooves 35, and the terminal fittings 20 are accommodated in the respective terminal accommodating chambers 38 in a positioned state (that is, a state of being restricted from being separated outside the dielectric 23).

In a state where the upper shell 41 and the lower shell 52 are united, the fitting protrusions 59 of the lower shell 52 are fitted into the fitting holes 49 of the upper shell 41, and the main protrusions 31 of the first side surface protrusions 30 of the upper case 24 are fitted to positioning the cut-outs 60 of the lower shell 52. As a result of the fitting, the upper shell 41 and the lower shell 52 become a positioned state in which the relative displacement in the front-rear direction, the right-left direction, and the up-down direction is restricted, and held in the united state.

When the upper shell 41 and the lower shell 52 are united, the upper case 24 assembled to the upper shell 41 and the lower case 34 assembled to a female side seal portion are positioned and held in the united state. That is, the upper case 24 and the lower case 34 are held in the united state via the outer conductor 40. After that, the lower side crimping portion 55 is crimped onto the outer circumference of the upper side crimping portion 44. As a result, the lower shell 52 is integrated with the upper shell 41 and the electric wire 15, so that the lower case 34 is also restricted from being displaced in the front-rear direction, the right-left direction, and the up-down direction with respect to the outer cover 19 of the electric wire 15. Thus, the terminal module 14 is constituted.

The assembled terminal module 14 is inserted into the accommodating space 11 from the rear side of the housing 10. In the insertion process, the elastic retaining piece 12 interferes with the front wall portion 27 of the upper case and the upper shell 41 and is elastically displaced upward. When the terminal module 14 reaches a proper insertion position, the front stop portion 56 strikes the stopper 13, whereby further insertion operation of the terminal module 14 is restricted so that the terminal module 14 is positioned. At the same time, the elastic retaining piece 12 elastically returns to be locked to the retaining protrusion 45 from behind, and by this locking, the terminal module 14 is held in a retaining state.

Second Specification

Figure 16:
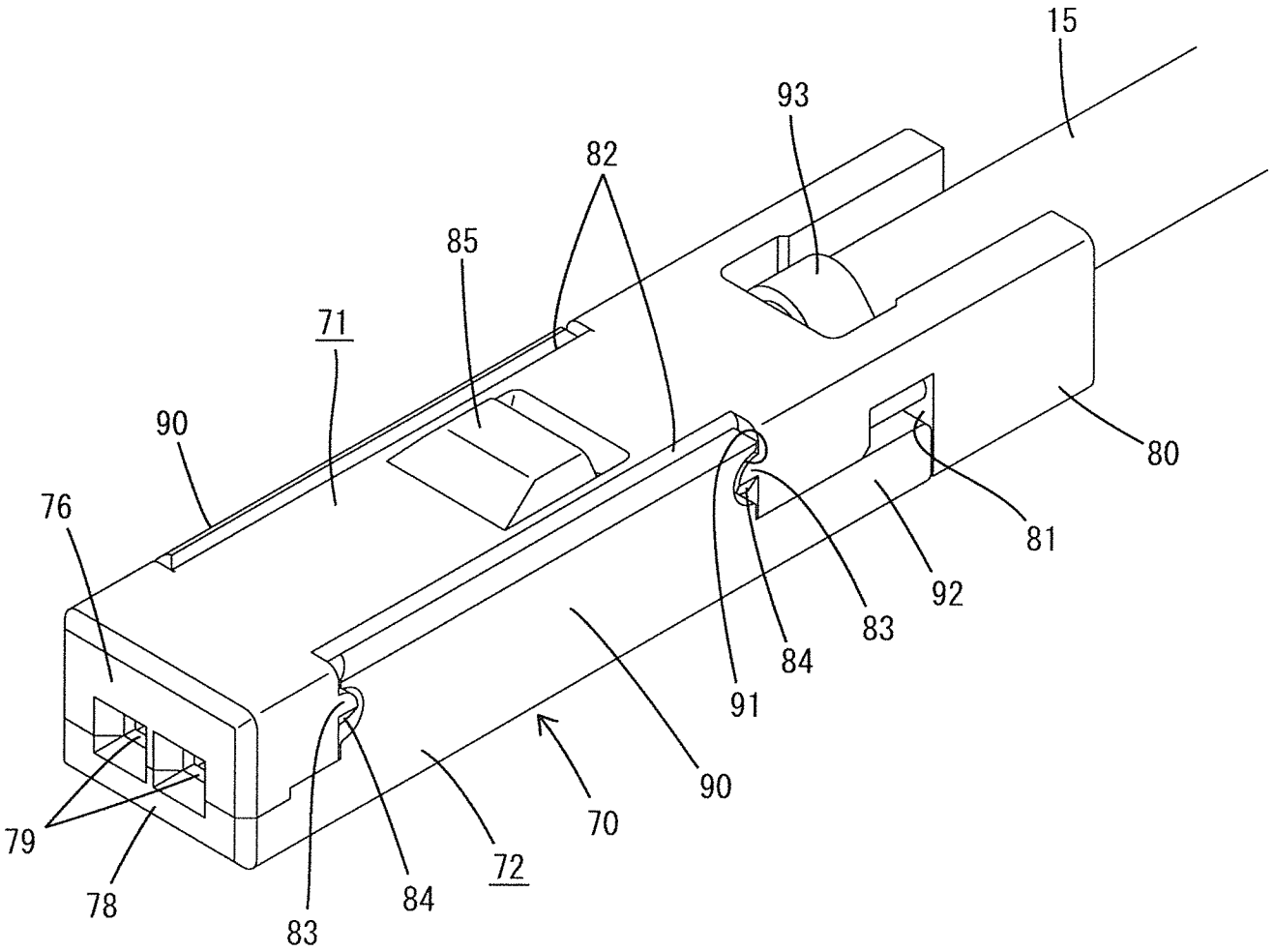
FIG. 16 is a perspective view of a state in which the upper and lower dielectrics are united as viewed from the upper surface side.

Hereinafter, the second specification will be described. As for a front-rear direction, the lower left direction in FIG. 16 is defined as a front side. As for an up-down direction, the directions shown in FIG. 16 are defined as an upper side and a lower side as they are. Also as for a right-left direction, the direction from the upper left side to the lower right side in FIG. 16 is defined as a right direction, and the opposite direction is defined as a left direction.

Although the outer conductor 40 used in the first specification is not used in the second specification, the terminal fitting 20 and the housing 10 in the first specification are used as they are in the second specification. With respect to the electric wire 15, although the electric wire 15 in the first specification can be used as it is, the electric wire 15 only exclusive of the braided wire 18 is used in the second specification. Accordingly, repeated explanation of the terminal fitting 20 and the housing 10 as well as the electric wire 15 will be eliminated. Also in the drawings, components common to those of the first specification are denoted by same reference numerals. In the second specification, a sub-housing 70 is used instead of the dielectric 23 in the first specification.

(Sub-Housing 70)

The sub-housing 70 of the present embodiment is vertically divided into two portions by a dividing plane extending along the longitudinal direction. As a result, the sub housing 70 is constituted of an upper sub-housing 71 and a lower sub-housing 72 each serving as a half body. The direction in which the upper sub-housing 71 and the lower sub-housing 72 are united is the up-down direction.

Figure 14:
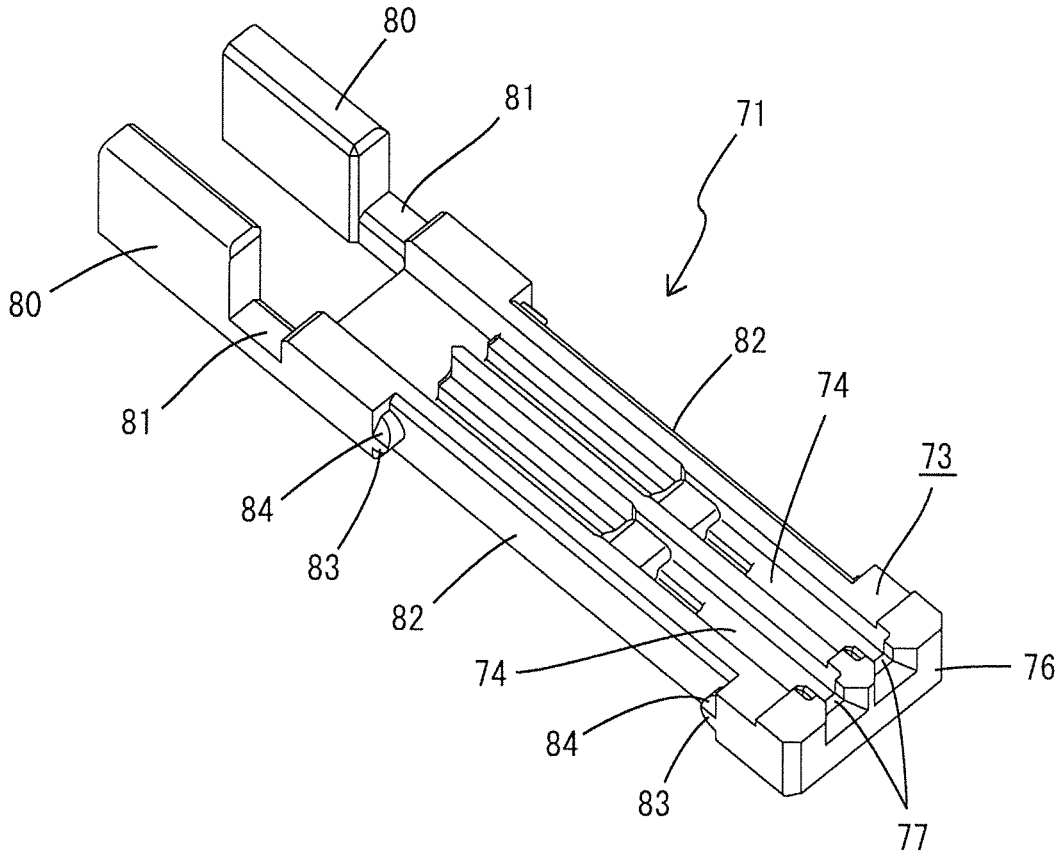
FIG. 14 is a perspective view of a lower dielectric.
Figure 18:
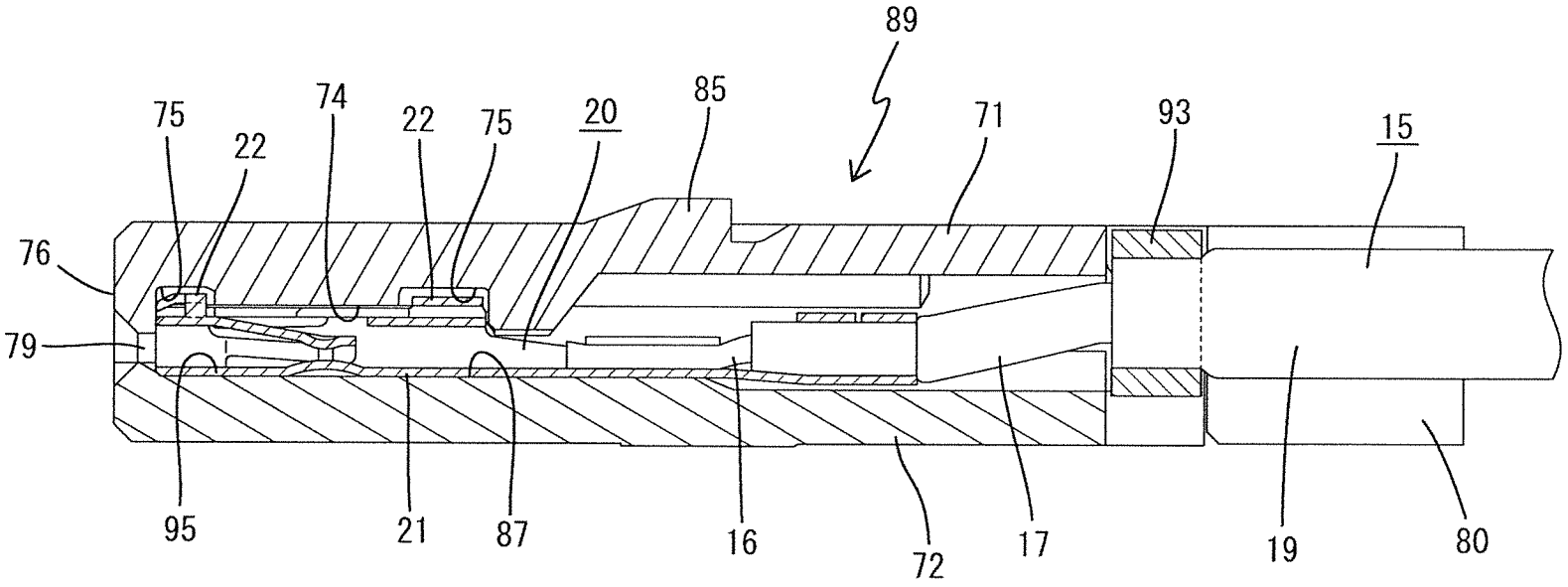
FIG. 18 is a side sectional view at a position where a front stop protrusion is removed in a state where the upper and lower dielectrics are united.

First, referring to FIG. 14, the upper sub housing 71 will be described. The upper sub-housing 71 is integrally formed of a synthetic resin material and has a base portion 73 formed in a plate shape. The base portion 73 is formed with right and left fitting recesses 74 in a form such that the inner surface side of the base portion 73 is recessed. Each of the fitting recesses 74 is elongated in the front-rear direction and is formed over a predetermined length range extending from a front end of the base portion 73 to a position close to the rear end portion. As shown in FIG. 18, the fitting recess 74 includes front and rear positioning recesses 75 in a form such that the upper surface of the fitting recess 74 is recessed. A substantially upper half of the terminal fitting 20 is accommodated in the fitting recess 74.

A front wall portion 76 protrudes down at a front end portion of the base portion 73. Right and left tab insertion openings 77 are formed in the front wall portion 76 so as to correspond to front ends of both fitting recesses 74. The tab insertion openings 77 are each formed such that a lower surface side thereof is open. As shown in FIG. 16, when the upper sub-housing 71 and the lower sub-housing 72 to be described later are united, the opening portions directed downward of the tab insertion openings 77 formed in the upper sub-housing 71 are closed by a closing wall 78 (see FIG. 15) formed in a front end portion of the lower sub-housing 72. Thus, right and left tab insertion openings 79 are formed. When female and male connectors (the male-side connector is not shown) are fitted together, tabs of male terminal fittings accommodated in the male-side connector respectively penetrate the tab insertion openings 79 and are inserted into the terminal body portions 21 of the terminal fittings 20 (female terminal fittings).

Figure 15:
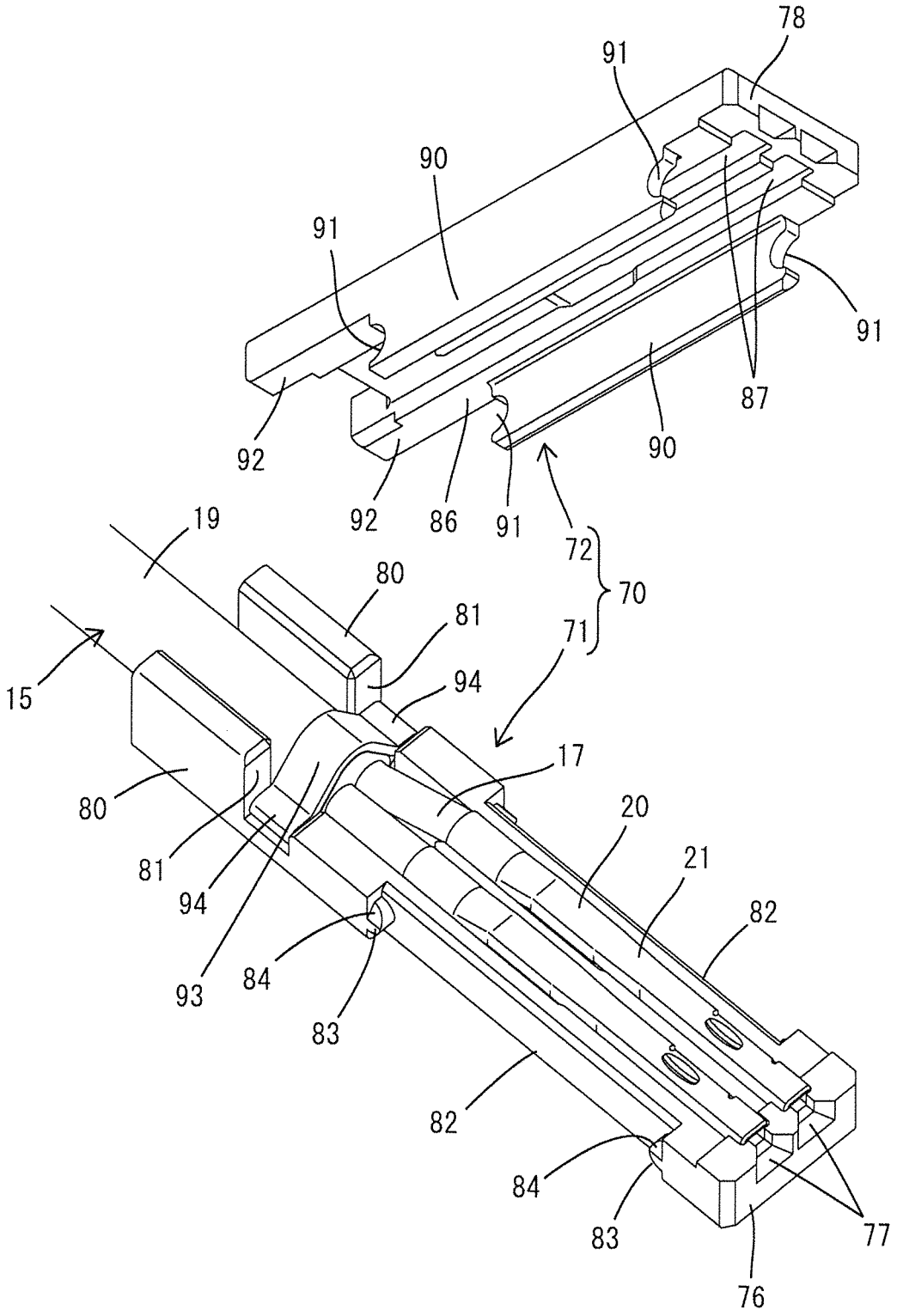
FIG. 15 is a perspective view showing the lower dielectric and an upper dielectric in a state where the terminal fitting is mounted.

As shown in FIG. 15 and so on, right and left extending portions 80 extend rearward from both left and right end portions in a rear portion of the base portion 73. Both extending portions 80 are formed to protrude down farther than the base portion 73 side. Right and left notch grooves 81 are provided between the extending portions 80 and the base portion 73 and each is formed to open downward and in the right-left direction.

Right and left recessed portions 82 are provided on both side surfaces of the base portion 73, so that the base portion 73 has a narrow width in the right-left direction in the region where the recessed portions 82 are provided. The recessed portions 82 are each formed over a predetermined length range between the front and rear end portions of the base portion 73. Further, each recessed portion 82 has end surfaces facing each other in the front-rear direction, and front and rear coupling protrusions 83 protrude on the end surfaces so as to face each other in the front-rear direction. Each of the coupling protrusions 83 is formed in a substantially semicircular shape in a side view, and a lower half of the outer surface thereof is formed with an inclined surface 84 inclined upward.

Figure 19:
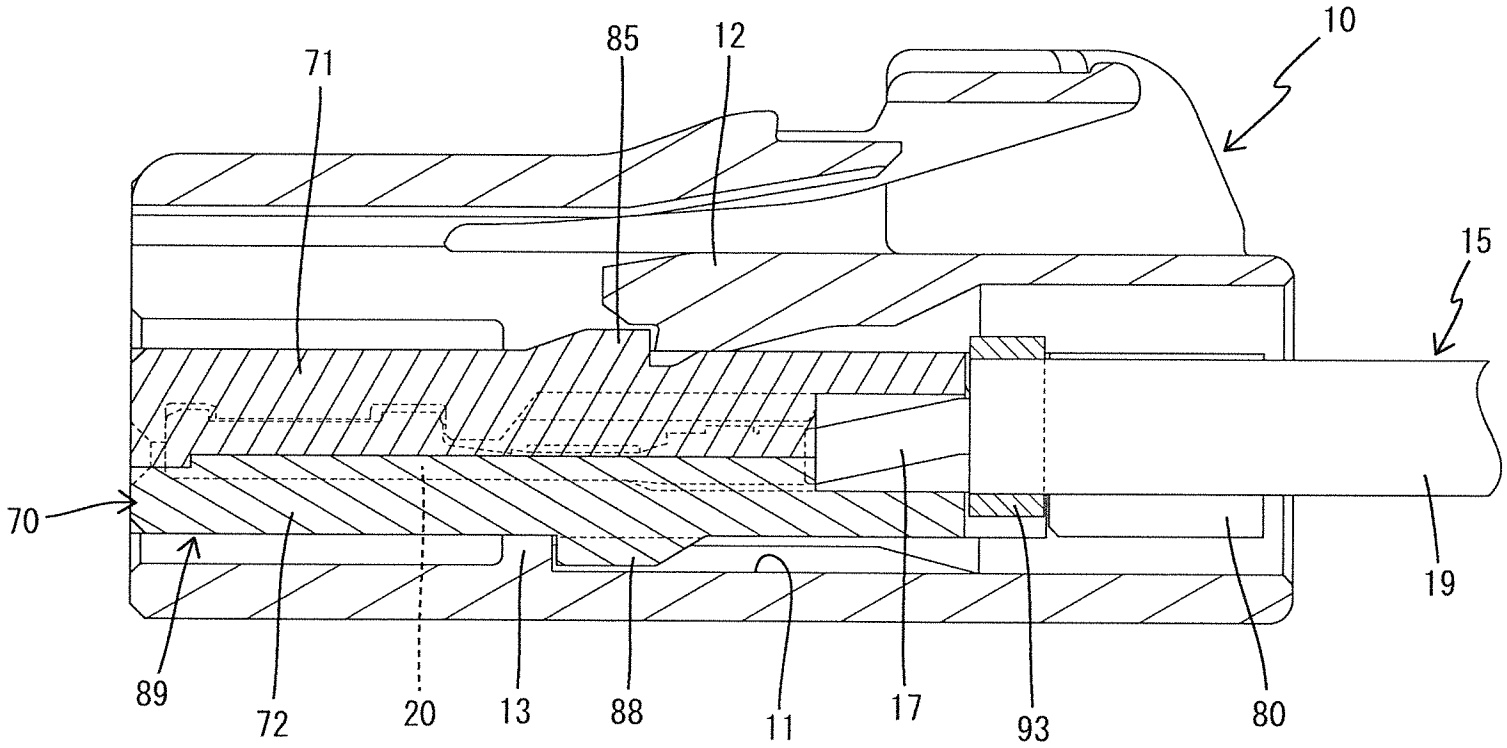
FIG. 19 is a side sectional view showing a state of being incorporated into a housing.

As shown in FIGS. 16 and 19, a lock receiving portion 85 that can be locked to the elastic retaining piece 12 (the lock portion of the claims) of the housing 10 protrudes on the upper surface of the base portion 73, at substantially a central portion of the upper surface in the front-rear direction. A front surface of the lock receiving portion 85 is inclined up and toward the rear, and a rear surface of the lock receiving portion 85 is formed to stand upright substantially vertically.

The lower sub-housing 72 also is formed integrally of a synthetic resin. The lower sub-housing 72 has a flat plate-like base plate portion 86. When the upper and lower sub-housings 71 and 72 are united, the base plate portion 86 covers the open side of the base portion 73 of the upper sub-housing 71.

The base plate portion 86 is formed with right and left fitting grooves 87 in a form such that the inner surface side of the base plate portion 86 is recessed. The fitting grooves 87 are elongated in the front-rear direction and formed along the front-rear direction of the base plate portion 86. As shown in FIG. 18, a substantially lower half portion of the terminal fitting 20 is accommodated in the fitting grooves 87. The terminal fitting 20 accommodated in the fitting groove 87 is sandwiched by inner surfaces of the fitting groove 87 and thereby positioned in a state where displacement in the right-left direction is restricted.

Figure 17:
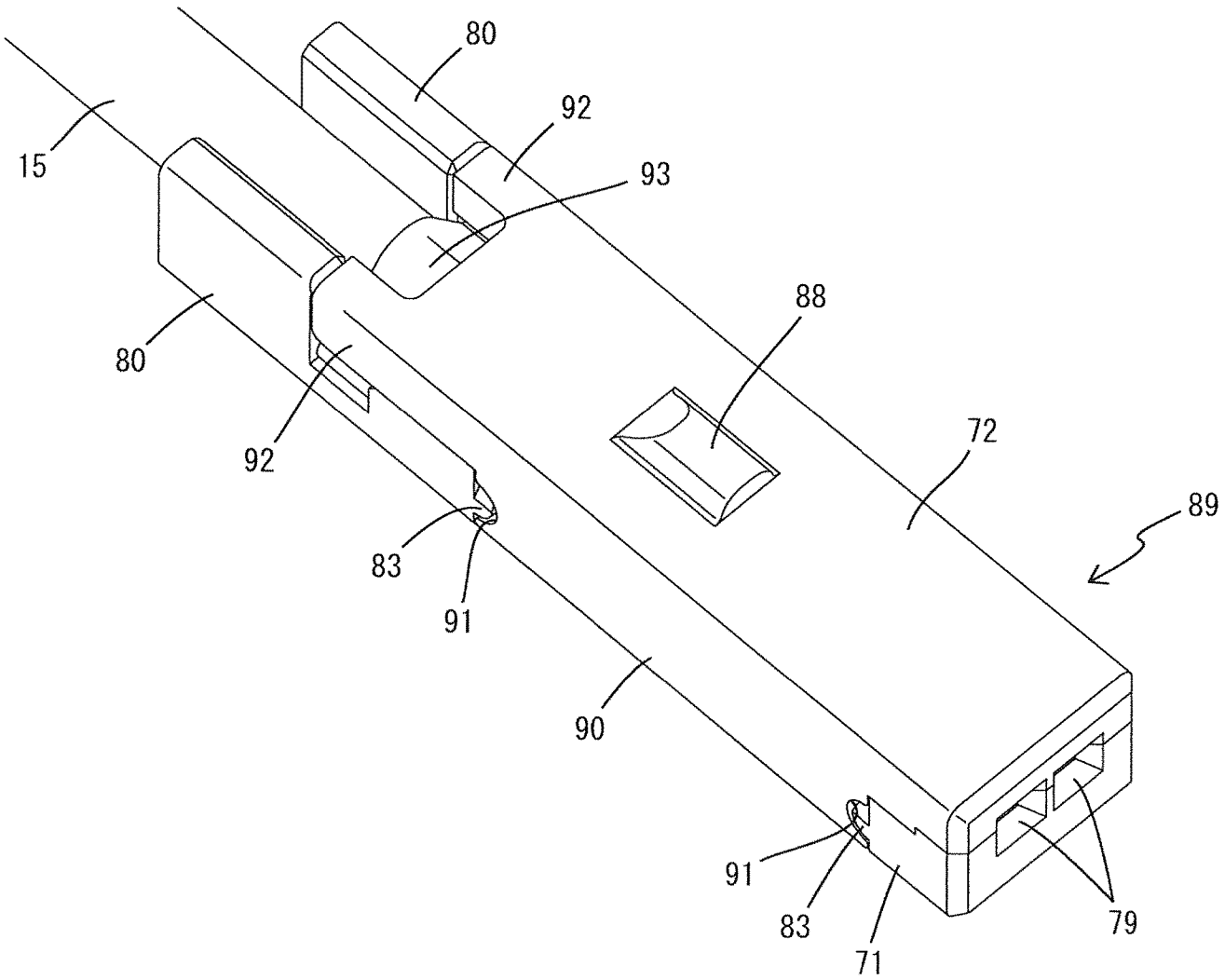
FIG. 17 is a perspective view thereof as viewed from the lower surface side.

As shown in FIG. 19, a restricting protrusion 88 protrudes on the lower surface of the lower sub housing 72. The restricting protrusion 88 is disposed at a central portion of the base plate portion 86 in a longitudinal direction and a right-left direction. As shown in FIG. 19, when the upper and lower sub housings 71 and 72 are united, the restricting protrusion 88 is disposed at substantially the same position as the lock receiving portion 85 with respect to the front-rear direction. The width of the restricting protrusion 88 in the right-left direction is set narrower than the lock receiving portion 85. Although a front surface of the restricting protrusion 88 stands upright in the vertical direction, a rear surface thereof is provided with a descending gradient directed forward. When a terminal module 89 (in which terminal fittings are incorporated in the sub-housing 70) as shown in FIGS. 16 and 17 is inserted into the housing 10 to a proper position, as shown in FIG. 19, the front surface of the restricting protrusion 88 strikes the stopper 13 of the housing 10 thereby to stop the terminal module 89 at the front-limit position, and at the same time, the elastic retaining piece 12 and the lock receiving portion 85 are locked to each other. As a result, the terminal fittings 20 are incorporated into the housing 10 in a state of being restricted from moving forward and coming off rearward.

Both right and left side edges of the base plate portion 86 are provided with a pair of upright side walls 90. Both side walls 90 are allowed to be elastically deformed so as to expand outwards. When being united, the side walls 90 can be fitted to both recessed portions 82 of the upper sub-housing 71 and fitted therein while coming in close contact with side surfaces of the recessed portions 82 from outside and sandwiching them.

Front and rear coupling recesses 91 are recessed at the front and rear end edges of each of the side walls 90A. Each of the coupling recesses 91 is formed to be recessed into a semicircular shape, and when the upper sub-housing 71 and the lower sub-housing 72 are united, each coupling protrusion 83 of the upper sub-housing 71 is fitted into the corresponding coupling recess 91 of the lower sub-housing 72. As a result, the upper and lower sub-housings 71 and 72 are connected together so as not to be separated from each other and also positioned in the right-left direction and in the front-rear direction.

Right and left overhang pieces 92 extend rearward at both right-left end portions of a rear end portion of the base plate portion 86. When the upper and lower sub-housings 71 and 72 are united as shown in FIGS. 16 and 17, rear end surfaces of the overhang pieces 92 strike the front end surfaces of the extending portions 80 of the upper sub-housing 71.

(Assembling Process of Second Specification)

In the second specification, the terminal fittings 20 and the housing 10 are used in common to the first specification. As described above, although the electric wire 15 is not provided with the braided wire 18, the other configuration is same as the electric wire 15 used in the first specification. (Completely same electric wire as the first specification, that is, the type provided with the braided wire 18 may be used.) In the present embodiment, the outer cover 19 is peeled off at the end of the electric wire 15, and the insulating inner covers 17 are exposed in an untwisted state over a predetermined range. Further, the insulating inner cover 17 is peeled off at a terminal thereof to expose the core wire 16. In this state, the core wire 16 and the insulating inner cover 17 are respectively swaged at a rear portion of the terminal fitting 20, whereby the terminal fitting 20 is connected to the electric wire 15. Particularly, in the second specification, a swaging ring 93 is mounted to an end portion of the outer cover 19 (see FIG. 15, etc.).

The swaging ring 93 is formed of metal, and when swaged, the swaging ring 93 is deformed into a ring shape so that the outer cover 19 of the electric wire 15 is tightened over the entire circumference and two crushed portions 94 are deformed so as to project in the right-left direction, as shown in FIG. 15. The electric wire with the terminal fitting to which the swaging ring 93 is thus mounted is set in the upper sub-housing 71.

In this case, the terminal fitting 20 is not inserted from the rear side of the upper sub-housing 71, but is put down from above toward the fitting recess 74 with respect to the upper sub-housing 71 whose open side faces upward. That is, both terminal fittings 20 are fitted into the corresponding fitting recesses 74 from the dividing plane side of the sub-housing 70, which is a direction intersecting with the front-rear direction. When the terminal fitting 20 is fitted into the upper sub-housing 71, the positioning protrusions 22 are fitted into the positioning recesses 75 so that the terminal fitting 20 becomes a positioned in both front-rear direction and the right-left direction with respect to the upper sub-housing 71. Simultaneously, the swaging ring 93 is fitted into the notch grooves to enhance the positioning function in the front-rear direction. The swaging ring is swaged onto the outer cover 19, so that the outer cover 19 and the insulating inner cover 17 are swaged. As a result, it is possible to avoid the situation where the outer cover 19 is displaced with respect to the insulating inner cover 17 when the electric wire 15 is pulled. Thus, the terminal fittings 20 are held temporarily with respect to the upper sub housing 71 (the state shown in FIG. 15).

Next, the lower sub-housing 72 is united with the upper sub-housing 71 in which the terminal fittings 20 are temporarily held as described above (see FIGS. 16 to 18). The lower sub-housing 72 is united with the upper sub-housing 71 so as to sandwich the terminal fittings 20 with respect to the upper sub-housing 71 being turned upside down. When united, the fitting groove 87 of the lower sub-housing 72 fits to the substantially lower half portion of the terminal fitting 20, and the sub-housing 70 is constituted by the upper sub-housing 71 and the lower sub-housing 72. In the sub-housing, two terminal accommodating chambers 95 are formed by the fitting recesses 74 and the fitting grooves 87, and the terminal fittings 20 are accommodated in the terminal accommodating chambers 95 in a retained state.

In the state where the upper sub-housing 71 and the lower sub-housing 72 are united, each of the coupling protrusions 83 is fitted in the corresponding coupling recess 91. As a result, the upper sub-housing 71 and the lower sub-housing 72 become a positioned state in which the relative displacement in the front-rear direction, the right-left direction, and the up-down direction is restricted, and held in the united state.

In this united state, a portion surrounding (accommodating) the terminal fittings 20 and the electric wire 15 by the upper sub-housing 71 and the lower sub-housing 72 has substantially the same outer shape and size as the portion surrounding (accommodating) the terminal fittings 20 and the electric wire 15 by the upper shell 41 and the lower shell 52 in the united state in the first specification. Thus, a terminal module 89 that can be replaced with the terminal module 14 in the first specification is constituted.

The assembled terminal module 89 is inserted into the accommodating space 11 from the rear side of the housing 10. In the insertion process, the terminal module 89 interferes with the front wall portion 76 of the upper sub-housing 71 and is elastically displaced upward. When the terminal module 89 is inserted to a proper position, the front surface of the restricting protrusion 88 strikes the stopper 13 of the housing 10, whereby the terminal module 89 is stopped at the front-limit position. At the same time, the elastic retaining piece 12 elastically returns to be locked to the lock receiving portion 85 from behind.

As described above, since the outer shape and size of the portion surrounding the terminal fittings 20 and the electric wire 15 in the sub housing 70 constructed in the united state in the second specification are set to be substantially the same as the outer shape and size of the portion surrounding the terminal fittings 20 and the electric wire 15 in the outer conductor 40 constructed in the united state in the first specification, a locking margin of the restricting protrusion 88 with respect to the stopper 13 and a locking margin of the lock receiving portion 85 with respect to the elastic retaining piece 12 are substantially same as those in the first specification. As a result, also in the second specification, the terminal module is held in a good retained state as in the first specification.

The following explains the effect of the present embodiment configured as described above. Since the outer shape and size of the portion surrounding the terminal fittings 20 and the electric wire 15 in the sub-housing 70 in the second specification are set to be substantially same as the outer shape and size of the portion surrounding the terminal fittings 20 and the electric wire 15 in the outer conductor 40 in the first specification, the terminal module 89 can be held in the retained state with the same locking situation as in the first specification even if the outer conductor 40 is omitted. That is, the sub-housing 70 in the second specification may take any configuration as long as the terminal fittings 20 can be accommodated in the retained state and the sub-housing 70 is stopped at the front-limit position and retained in the housing 10 with the same locking margin as that of the first specification.

Thus, it is possible to reliably respond to a selection request between the first specification and the second specification. In that case, since at least the terminal fitting 20 and the housing 10 are used in common between both specifications, it is possible to achieve cost reduction and facilitate parts management. The electric wire 15 also can be used in common between both specifications, and in such a case, it is more advantageous in terms of cost and parts management.

In the first specification, the dielectric 23 as well as the outer conductor 40 are each vertically divided into two portions vertically, and in the second specification, the sub-housing 70 is vertically divided into two portions, so that the terminal metal fitting 20 can be fitted therein not from the rear but from the dividing plane side and held in the retained state. As already described above, in a case where the terminal fitting 20 is to be inserted from the rear with respect to the one integrally formed without being divided into two portions, a deflection space like a lance needs to be secured inside as means for preventing the terminal fitting 20 from coming off, with the result that the size of the sub-housing 70 inevitably is increased. However, in the present embodiment, since it is unnecessary to secure the deflection space inside the sub-housing 70 in the second specification and the dielectric 23 in the first specification, they can be miniaturized. Accordingly, the common housing 10 also can be rendered small in size, which can contribute to miniaturization of the connector.

The electric wires 15 used in both specifications are each formed such that two insulating inner covers 17 are collectively covered with the outer cover 19. Therefore, a gap may be generated between the insulating inner covers 17 and the outer cover 19, and positional displacement of the outer cover 19 with respect to the insulating inner cover 17 tends to occur. In view of this, in the first specification, the outer conductor 40 swages the outer cover 19 of the electric wire 15 via the braided wire 18, and in the second specification which does not have the outer conductor 40, the dedicated swaging ring 93 swages the outer cover 19. As a result of these configurations, the outer cover 19 and the insulating inner covers 17 are swaged and establish a fastened relationship in either of the specifications, so that it is possible to reliably avoid a situation where the outer cover 19 is displaced with respect to the insulating inner cover 17 when a pulling force is applied to the electric wire 15.

As already described above, in the second specification, the electric wire 15 may have the braided wire 18, and in that case, the outer cover 19 is swaged by the swaging ring 93 via the folded-back braided wire 18.

REFERENCE SIGNS LIST

10: housing
12: elastic retaining piece (lock portion)
15: electrical wire
18: braided wire (shield layer)
20: terminal fitting
23: dielectric
40: outer conductor
51: upper side swaging piece
70: sub-housing
71: upper sub-housing
72: lower sub-housing
85: lock receiving portion
93: swaging ring

What is claimed is:

1. A connector capable of selecting either a first specification or a second specification, the first specification comprising a terminal fitting, a dielectric formed of an insulating material and accommodating the terminal fitting, an outer conductor that is formed of a conductive material and surrounds the dielectric, and a housing that accommodates the terminal fitting, the dielectric, and the outer conductor, the second specification not comprising the dielectric and the outer conductor and comprising a sub housing that is accommodated in the housing while accommodating the terminal fitting, wherein the dielectric and the sub housing are each divided into a pair of half bodies by a dividing plane along the longitudinal direction thereof, and when the terminal fitting is fitted into one of the half bodies from the dividing plane side, a part of the terminal fitting is capable of being locked non-elastically to a lock portion formed in the one half body, and when both half bodies are united, the terminal fitting is accommodated therein in a retained state.

2. The connector according to claim 1, wherein an electric wire that is attached to the terminal fitting is a twisted wire formed by twisting two core wires together, the core wires being covered with respective insulating inner covers, the first specification using a shielded electric wire provided with a braided wire and an insulating outer cover, the braided wire collectively surrounding the insulating inner covers, the insulating outer cover surrounding the braided wire, the braided wire being selectively usable in the electric wire in the second specification;

wherein in the first specification, the braided wire in a state of being exposed by peeling off of an end portion of the outer cover and folded back onto the outer cover is swaged by a swaging piece formed in the outer conductor; and wherein in the second specification, a swaging ring is provided which indirectly swages the outer cover with the folded-back braided wire being interposed therebetween, or directly swages the outer cover without the braided wire being interposing therebetween.

* * * * *